United States Patent [19]

Matuura et al.

[11] Patent Number: 4,746,954

[45] Date of Patent: May 24, 1988

[54] IMAGE FORMING APPARATUS WITH TONER SCATTERING CONTROL

[75] Inventors: Masami Matuura, Kanagawa; Ichizo Nagata, Machida; Kuniaki Kamimura, Ebina, all of Japan

[73] Assignee: Minolta Camera Kabushiki Kaisha, Osaka, Japan

[21] Appl. No.: 860,217

[22] Filed: May 6, 1986

[30] Foreign Application Priority Data

| | | | |
|---|---|---|---|
| May 14, 1985 | [JP] | Japan | 60-103468 |
| Aug. 30, 1985 | [JP] | Japan | 60-192549 |
| Dec. 9, 1985 | [JP] | Japan | 60-277250 |
| Dec. 14, 1985 | [JP] | Japan | 60-281717 |

[51] Int. Cl.[4] ..... G03G 15/08

[52] U.S. Cl. ..... 355/14 D; 355/4; 355/3 DD

[58] Field of Search ..... 355/4, 3 R, 3 DD, 14 D

[56] References Cited

U.S. PATENT DOCUMENTS

| | | | |
|---|---|---|---|
| 4,494,863 | 1/1985 | Laing | 365/15 |
| 4,571,071 | 2/1986 | Bothner | 355/15 |
| 4,639,124 | 1/1987 | Nye, Jr. et al. | 355/4 X |
| 4,659,211 | 4/1987 | Oka | 355/3 DD X |

FOREIGN PATENT DOCUMENTS 54-104834 8/1979 Japan .

*Primary Examiner*—A. C. Prescott

*Attorney, Agent, or Firm*—Burns, Doane, Swecker & Mathis

[57] ABSTRACT

The present invention relates to an image forming apparatus having a plurality of developing units, one of which is selectively used for development. The image forming apparatus of the present invention provides for removing the toner intruding into the other developing unit. As a result, the intruding developer on the outer periphery of its developing sleeve can be removed from the developing station before a selected developing unit is initiated into developing operation.

6 Claims, 25 Drawing Sheets

IMAGE FORMING APPARATUS WITH TONER SCATTERING CONTROL

BACKGROUND OF THE INVENTION

1. Field of the Invention

The present invention relates to an image forming apparatus for producing copy images by an electrophotographic process or the like, and more particularly to the control of a plurality of developing units within the image forming apparatus.

2. Description of the Prior Art

Image forming apparatus, such as electrophotographic copying machines and reader-printers recently available, include those which are provided with two developing units arranged around an electrostatic latent image bearing member. One of the developing units is used for normal development (development for preparing a positive copy image from a positive original, hereinafter referred to as "P—P development"), and the other developing unit for reverse development (development for preparing a positive copy image from a negative original, hereinafter referred to as "N-P development"). Alternatively, one developing unit is filled with a developer containing a black toner, and the other developing unit with a developer containing a toner of other single colors such as red, yellow or blue. One of the developing units is selectively used for development.

However, the image forming apparatus of the type described has the problem that the toner (especially an insufficiently charged toner portion) is released from the developing station for the unit being used for development and becomes mixed with the developer in the other unit to produce fogged copy images when the other unit is thereafter used. This problem arises because the developing stations for the developing units are arranged adjacent to each other in the direction of rotation of the latent image bearing member, permitting the toner scattering from the developing station of the operating unit to intrude into the developer on the outer periphery of the developing sleeve of the other unit.

As a technique for removing the toner intruding into the other developing unit, it is already proposed to apply a bias voltage to an electrically conductive roller disposed within the second developing unit and electrostatically attract the mixed toner for separation and removal as disclosed, for example, in Unexamined Japanese Patent Publication No. SHO 54-104834.

According to the proposal, however, the toner is transported from the location of intrusion (developing station) to the separation removal position by the rotation of the developing sleeve or magnetic roller and is therefore mixed with the developer to a greater extent during the transport. The extraneous toner once mixed is very difficult to separate and remove.

On the other hand, various means appear useful for preventing the scattering of the toner, but means still remain to be provided for complete prevention.

SUMMARY OF THE INVENTION

The main object of the present invention is to provide an image forming apparatus which is adapted to completely remove the extraneous toner intruding into other developing unit free of the above drawback.

Another object of the present invention is to provide an image forming apparatus wherein before a selected developing unit is initiated into a developing operation, the developer on the outer periphery of its developing sleeve can be removed from the developing station, and be deposited on the surface of an electrostatic latent image bearing member at a portion thereof other than the image forming portion.

These and other objects of the present invention are accomplished by providing an image forming apparatus which comprises a plurality of developing units each having a developing sleeve for transporting a developer to a developing station, developing unit selecting means for positioning the developing sleeve of one of the developing units selected at a position opposite an electrostatic latent image bearing member and moving the developing sleeve of another developing unit from the position opposite the image bearing member, control means for stopping movement of the developer opposite the image bearing member and positioned on the developing sleeve of the developing unit not selected by the selecting means, and developer removing means for causing the selecting means to select the developing unit not used for development and removing and collecting the developer opposite the image bearing member and positioned on the outer periphery of the developing sleeve thereof.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE INVENTION

Figure 1:
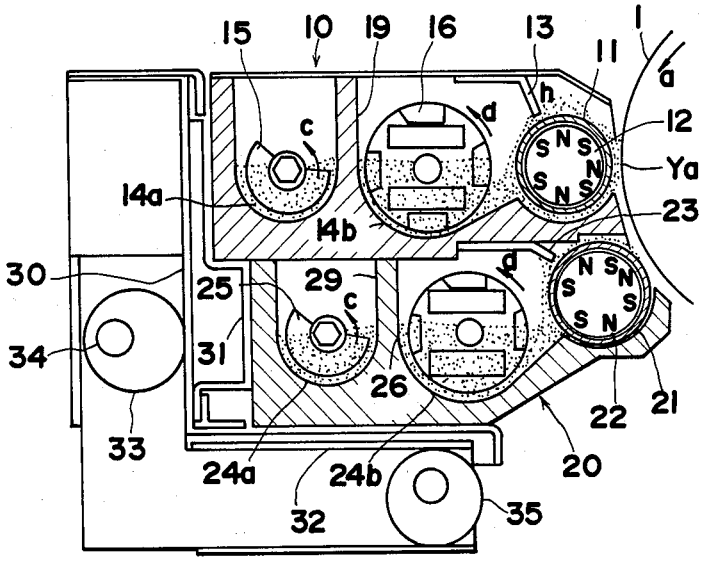
FIGS. 1 and 2 are views showing a developing unit assembly included in an image forming apparatus of the present invention, FIG. 1 showing the assembly when a first developing unit is selected, FIG. 2 showing the assembly when a second developing unit is selected.

FIG. 1 to FIGS. 7*a* and 7*b* are fragmentary views or diagrams showing a reader-printer for practicing a process for controlling developing units embodying the present invention. The reader-printer comprises a first developing unit 10 and a second developing unit 20 arranged in two stages and each adapted for developing the electrostatic latent image to be formed on a photosensitive drum 1 which is drivingly rotatable in the direction of arrow a.

The first and second developing units 10 and 20 are both of the magnetic brush type. The first unit 10 is designed for N-P development, and the second unit 20 for P—P development. These units have the following internal construction.

Each of the developing units 10, 20 has a developing sleeve 11 (21) opposite the photosensitive drum 1. The developing sleeve 11 (21) houses a magnetic roller 12 (22) having N and S poles arranged along its outer periphery. The developer is transported on the outer periphery of the developing sleeve 11 (21) in the direction of arrow b by the rotation of the sleeve 11 (21) in the direction of arrow b while being magnetically attracted to the sleeve outer periphery by the magnetic roller 12 (22). The amount of transport of the developer is regulated by a bristle height restricting plate 13 (23) when the developer passes under the plate.

On the other hand, provided in the rear of the developing sleeve 11 (21) are developer recycling channels 14*a*, 14*b* (24*a*, 24*b*) divided by a partition wall 19 (29) and communicating with each other at their opposite ends (i.e., near ends close to the plane of the drawing and the other remote ends). The channel 14*a* (24*a*) is provided with a screw roller 15 (25) drivingly rotatable in the direction of arrow c, and the channel 14*b* (24*b*) with a bucket roller 16 (26) drivingly rotatable in the direction of arrow d. The developer is circulated through the channels 14*a*, 14*b* (24*a*, 24*b*) by the rotation of the screw roller 15 (25) and the bucket roller 16 (26).

The toner for each of the developing units 10 and 20 is contained in a unillustrated toner bottle and is supplied to the near end of the channel 14*a* (24*a*) in response to a toner supply signal. The toner supplied is transported through the channel 14*a* (24*a*) toward its remote end while being agitated and mixed with the developer by the rotation of the screw roller 15 (25) and is charged during the transport. The developer is transferred from the channel 14*a* (24*a*) to the channel 14*b* (24*b*) at their remote ends, transported through the channel 14*b* (24*b*) toward its near end by the rotation of the bucket roller 16 (26) and fed to the outer periphery of the developing sleeve 11 (21).

The developing units 10 and 20 are held together by frames 30 and 31, pressed on rightward by cam plates 33 in pressing contact with the frame 30 and held in position by the bearing contact of a frame 32 with cam plates 35. Each of the cam plates 35 which are rotatable by the change motor 39 to be described below is adapted to assume a position in which a small diameter portion thereof is in contact with the frame 32 (see FIG. 1) and a position in which a large diameter cam portion is in contact with the frame 32 (see FIG. 2). The assembly of developing units 10 and 20 is revolvable upward or downward about a shaft 34 for the cam plates 33. When the small diameter portions of the cam plates 35 are in bearing contact with the frame 32, the units 10 and 20 are in an approximately horizontal position, with the developing sleeve 11 positioned at a developing station Ya and the developing sleeve 21 away from a developing station Yb. In this position, the first unit 10 is operable for development. Conversely, when the large diameter portions of the cam plates 35 come into contact with the frame 32, the units 10 and 20 are slightly revolved upward about the shaft 34, positioning the sleeve 21 at the developing station Yb and moving the sleeve 11 away from the developing station Ya. When thus positioned, the second unit 20 is ready for development.

Figure 3:
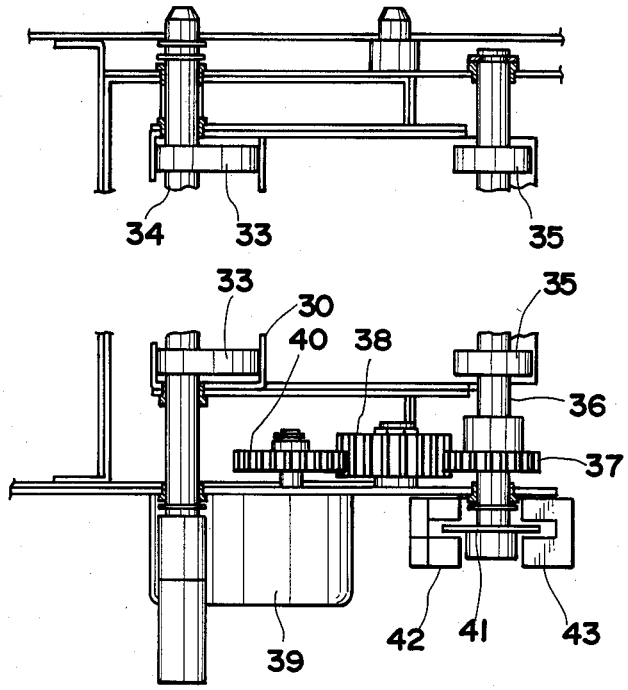
FIG. 3 is a sectional view showing a developing unit change mechanism.
Figure 4:
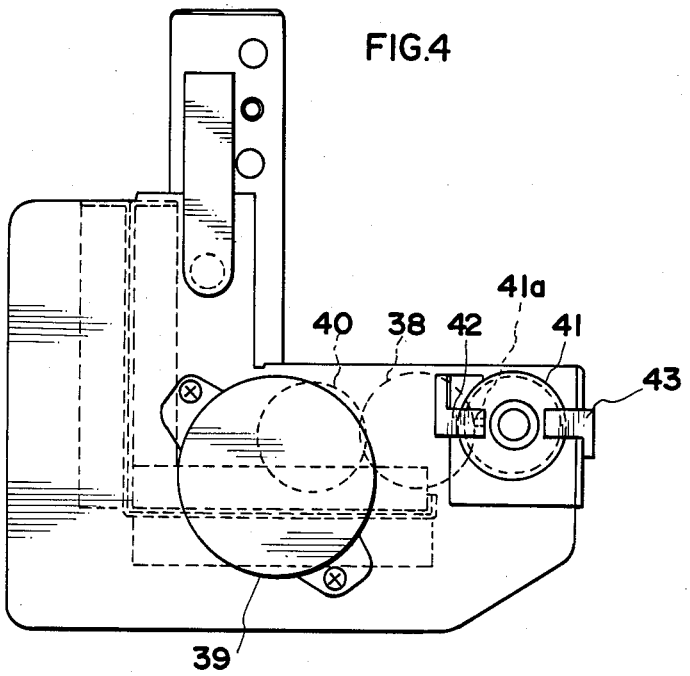
FIG. 4 is a view showing the change mechanism as it is seen from one side.
Figure 5:
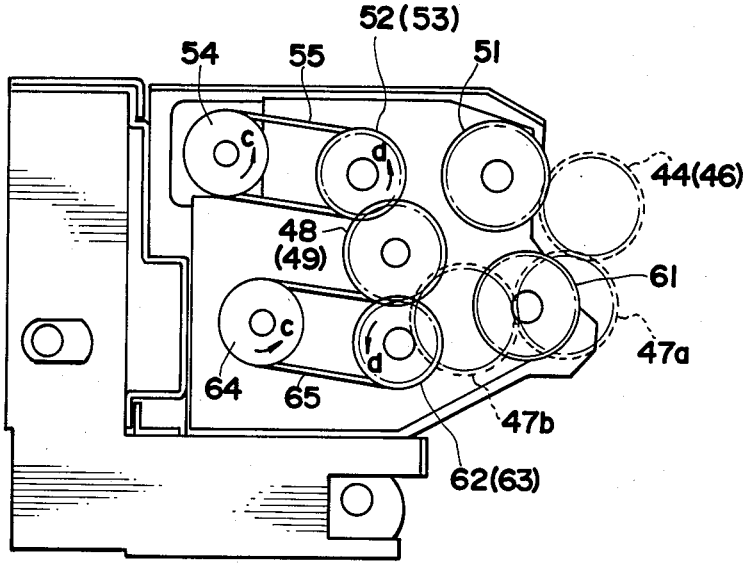
FIG. 5 is a front view showing a developing unit drive mechanism.
Figure 6:
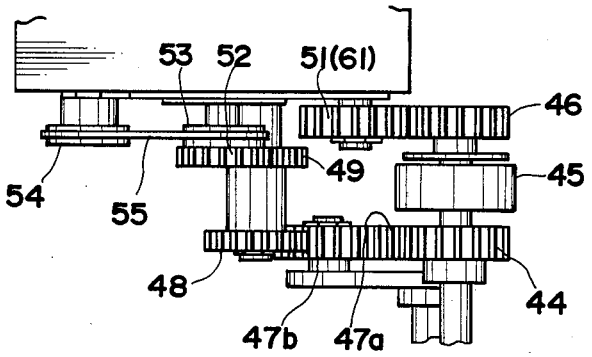
FIG. 6 is a view showing the drive mechanism as it is seen from above.
Figure 7A:
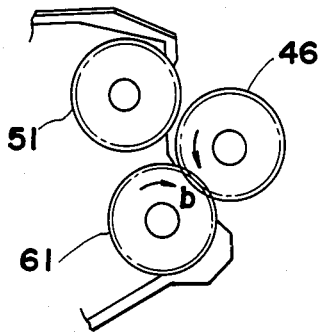
FIGS. 7*a* and 7*b* are diagrams showing part of the drive mechanism when selectively driving one of two developing sleeves.
Figure 7B:
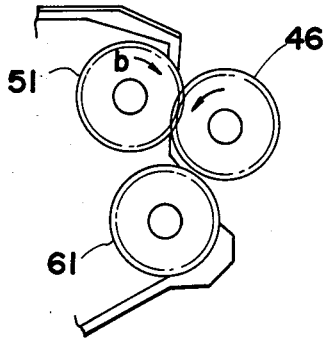

With reference to FIG. 3, the cam plates 35 are fixed to a shaft 36. A gear 37 fixed to the shaft 36 is coupled to an output gear 40 on a change motor 39 through an idle gear 38. Fixed to one end of the shaft 36 is a position sensor plate 41 opposed to transmission type position sensors 42 and 43. The sensor 42, which is provided for N-P development, detects a slit 41*a* in the sensor plate 41 to deenergize the change motor 39 when the motor 39 drives the cam plates 35 and brings their small diameter portions into contact with the frame 32. The other sensor 43, which is provided for P—P development, detects the slit 41*a* of the sensor plate 41 to deenergize the change motor 39 when the change motor 39 drives the cam plates 35 to bring their large diameter portions into contact with the frame 32.

The developing units 10 and 20 are driven by the mechanism to be described below with reference to FIGS. 5, 6, 7*a* and 7*b*.

A gear 44 connected to the output shaft of an unillustrated developing unit drive motor is coupled by a clutch 45 to a drive gear 46 which is meshable with gears 51, 61 fixed to the ends of shafts of the developing sleeves 11, 21, respectively. The gear 46 meshes with the gear 51 (see FIG. 7*b*) when the first developing unit 10 is selected or with the gear 61 (see FIG. 7*a*) when the second developing unit 20 is selected, to drive the gear 51 or 61 in the direction of arrow b. Further the gear 44 is coupled by idle gears 47*a*, 47*b* to a gear 48. A drive gear 49 fixed to the same shaft as the gear 48 is in mesh with gears 52, 62 fixed to the shaft ends of the bucket rollers 16, 26 to drive the gears 52, 62 in the direction of arrows d. Pulleys 54, 64 fixed to the shaft ends of the screw rollers 15, 25 are coupled by belts 55, 65 to pulleys 53, 63 integral with the gears 52, 62, respectively. Thus, the pulleys 54, 64 are driven in the direction of arrows c.

The developer comprises a mixture of magnetic carrier and toner, more specifically, a binder-containing magnetic carrier of reduced size and a nonmagnetic insulating toner. When the developer filled in the first developing unit 10 is triboelectrically charged, the magnetic carrier is charged positively and the toner negatively. In the case of the developer filled in the second unit 20, the magnetic carrier is charged negatively and the toner positively.

When the first developing unit 10 at the upper stage is used for N-P development, the surface of the photosensitive drum 1 is first charged to −600 V at the upstream side thereof with respect to the direction of rotation (arrow a) and then exposed to the image of a negative to form an electrostatic latent image, which is developed by the sleeve 11 with application of developing bias of −500 V. At this time, the toner is deposited on the image area (low potential area) of the latent image, forming a positive developed image. The toner image is transferred to copy paper by discharge of positive polarity of an unillustrated transfer charger disposed downstream of the unit with respect to the direction of arrow a. Alternatively when the second developing unit 20 at the lower stage is used for P—P development, the drum 1 is similarly charged to −600 V and exposed to a positive image to form a positive electrostatic latent image, which is then developed by the sleeve 21 with application of developing bias of −200 V. At this time, the positively charged toner is deposited on the image area (high potential area) of the latent image to form a positive developed image. The image is transferred to copy paper by positive discharge of the transfer charger.

Figure 2:
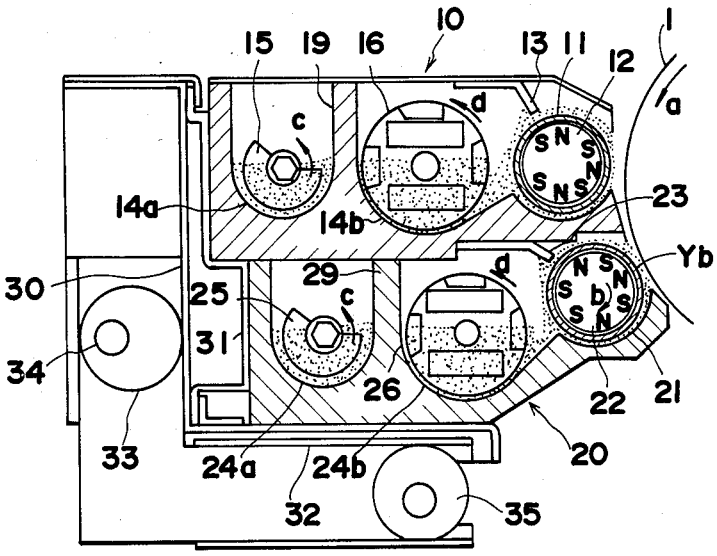

For use in development, one developing unit is changed over to the other by manipulating a selecting switch on an unillustrated operation panel. In response to the resulting selecting signal, the change motor 39 is energized to rotate the cam plates 35. When the first developing unit 10 is selected, the small diameter portions of the cam plates 35 are brought into contact with the frame 32 to position the developing sleeve 11 close to the drum 1 as shown in FIG. 1, whereas when the second unit 20 is selected, the large diameter portions of the cam plates 35 are brought into contact with the frame 32 to position the developing sleeve 21 close to the drum 1 as seen in FIG. 2. While the developing unit 10 or 20 is not in use, the screw roller 15 or 25 and the bucket roller 16 or 26 are driven to continue circulation of the developer, but the sleeve 11 or 21 is at rest, with the gear 46 held out of meshing engagement with the gear 51 or 61.

The developing sleeve 11 or 21 of the unit 10 or 20 not in use is held away from the surface of the drum 1 and out of rotation in this way in order to completely obviate unnecessary development by the unit 10 or 20 not in use, to preclude the image developed by one of the units 10 and 20 from being scraped off by the developer on the developing sleeve of the other unit and thereby disturbed, and further to eliminate the likelihood that a portion of toner scattering from the developing station Ya or Yb for the unit 10 or 20 in use and intruding into the developer on the outer periphery of the developing sleeve 21 or 11 of the other unit 20 or 10 will intrude further into the developer. The intruded toner is removed by the following control process.

The process for controlling the developing units will be described.

Figure 10:
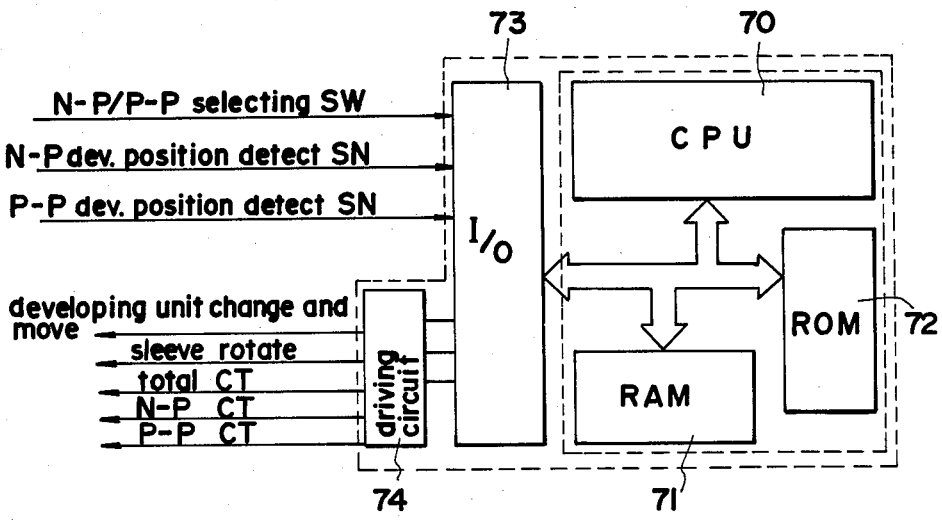
FIG. 10 is a block diagram showing the circuit of a control system.

A control circuit will be described first generally with reference to FIG. 10. The control circuit consists primarily of a microcomputer 70 and includes a random access memory 71, a read-only memory 72 and an input-output interface 73. The interface 73 has input ports for receiving signals from the N-P/P—P selecting switch and signals from N-P and P—P development position sensors 42 and 42, and output ports for delivering via a driving circuit 74 developing unit change and move signals, developing sleeve rotation signals, total copy number count signals, N-P development copy number count signals, P—P development copy number count signals, etc.

The control circuit has a multitask monitor for supervising the overall operation of the reader-printer as divided into a plurality of tasks. The plurality of tasks dividedly covering the reader-printer operation include scanning of the optical system, N-P/P—P change process, feeding of paper, temperature control for heatfixing unit, operation switch checking, exposure control, toner replenishment control, detection of paper jams, etc. The plurality of tasks are supervised by the multitask monitor as if they were conducted concurrently.

Next, a first embodiment of control process will be described with reference to the flow charts of FIGS. 11 and 12 and to the diagrams of FIGS. 8 and 9.

Figure 11:
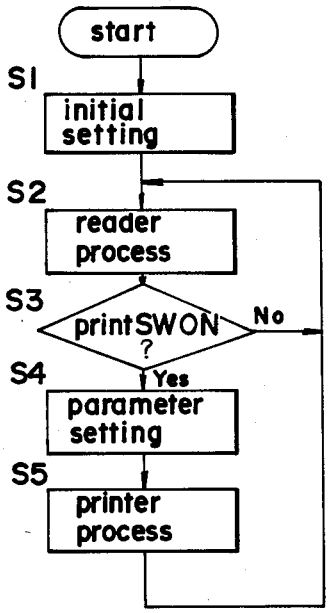
FIG. 11 is a flow chart showing the main control routine for the image forming apparatus of the invention.

FIG. 11 shows the overall control process for the reader-printer. When the power supply is turned on for starting the machine, all parameters are set to initial values in step S1, setting the machine in reader mode. A reader process is executed in step S2. Step S3 checks whether the print switch is on. If the print switch is not on (NO to the inquiry of step S3), the reader process only of step S2 is repeated. When the print switch is on (YES to the inquiry of step S3), copying parameters (image forming conditions, etc.) are set and the mode is changed to printer process mode in step S4 based on a signal from the N-P/P—P selecting switch previously manipulated for selection. A printer process is excecuted in step S5 after the completion of, or concurrently with, the above-mentioned various tasks.

When the printer process is to be conducted, the developing sleeve of the selected developing unit is positioned at its developing station and the sleeve of the other unit is moved away from its developing station by the operation of the change motor 39, whereupon the latter sleeve is brought out of rotation.

Figure 8:
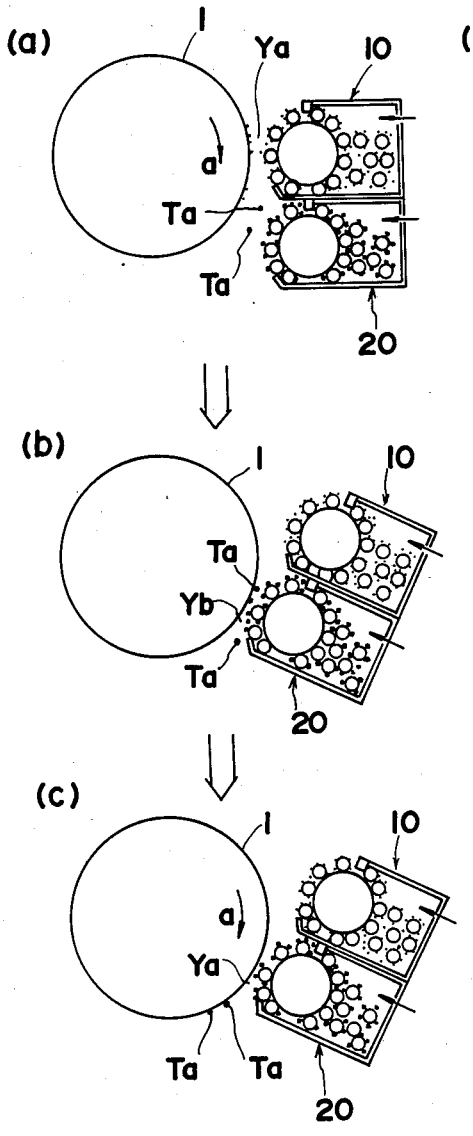
FIGS. 8*a*, 8*b*, 8*c*, 9*a* 9*b* and 9*c* are schematic diagrams for illustrating control procedures for the image forming apparatus of the invention.
Figure 9:
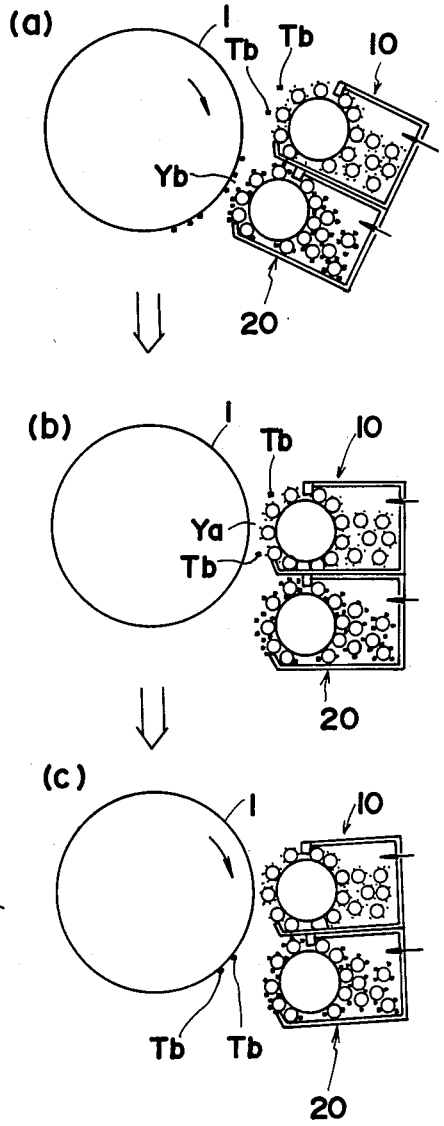

During development, a small amount of toner Ta or Tb scatters from the developing unit in use and intrudes into the developer on the outer periphery of the sleeve of the other developing unit as already described and shown in FIG. 8 (*a*) or 9 (*b*). Accordingly, an intruded toner removal process is practiced before executing the copying process as will be described below.

Figure 12:
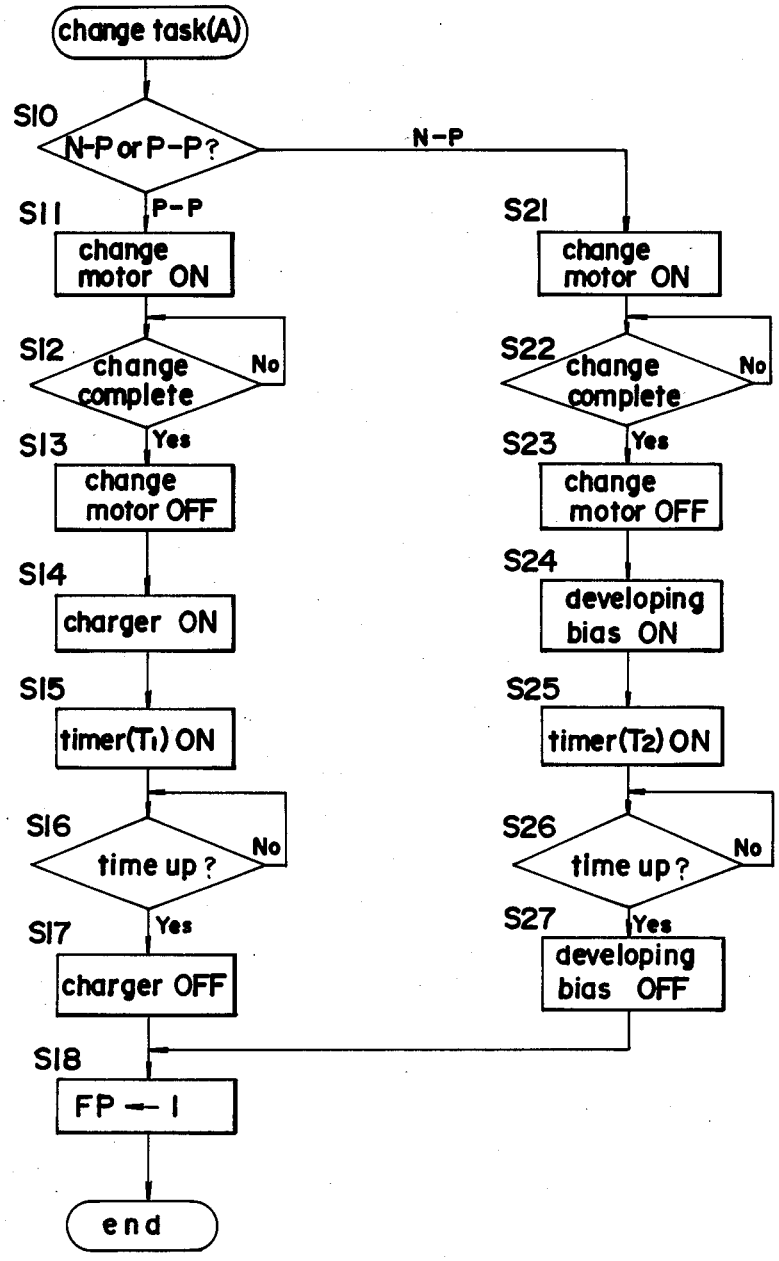
FIG. 12 is a flow chart showing a change task subroutine.

FIG. 12 shows the subroutine of a change task (A) as an exemplary control process.

With this subroutine, step S10 first checks which of N-P development and P—P development is selected. When P—P development is selected, steps S11 et seq. are performed, while when N-P development is selected, steps 21 et seq. are performed. More specifically, step S11 (S21) turns on the change motor 39, and the change is completed in step S12 (S22), whereupon the change motor 39 is turned off in step S13 (S23) in response to a signal from the position sensor 43 (42) (see FIG. 8 (*b*) or 9 (*b*)).

For P—P development, the sensitizing charger is turned on in step S14 to charge the surface of the drum 1 already in rotation to −600 V. A timer T1 is turned on in step S15. When the set time is up in step S16, the sensitizing charger is turned off in step S17. At this time, the toner Ta intruding into the developer positioned at the developing station for the second developing unit 20 for P—P development is removed from the outer periphery of the developing sleeve 21 at rest along with the normal toner, as deposited on the charged area of the drum 1 (see FIG. 8 (*c*)). The toner is then removed from the drum 1 by an unillustrated cleaner. The time set on the timer T1 is a period of time taken for a point on the drum 1 to move from the sensitizing charger to the developing station, plus a period of time required for removing the intruded toner. On completion of the removal of the intruded toner Ta, a process flag FP is set to "1" in step S18, whereby the subroutine is completed. The control system then starts a copying process by P—P development, for example, by engaging the clutch for rotating the developing sleeve.

For N-P development, on the other hand, the developing bias source is turned on in step S24 to apply a developing bias of −500 V to the developing sleeve 11 of the first developing unit 10 for N-P development, with the drum 1 already in rotation. A timer T2 is turned on in step S25, and the set time is up in step S26, whereupon the bias source is turned off in step S27. At this time, the toner Tb intruding into the developer positioned at the developing station for the first developing unit 10 for N-P development is removed along with the normal toner from the outer periphery of the developing sleeve 11 at rest by adhering to the unsensitized drum 1. Thus, the extraneous toner is removed from the normal developer (see FIG. 9 (*c*)) and further from the drum 1 by the unillustrated cleaner. The time set on the timer T2 is a period of time required for removing the intruded toner. On completion of the removal of the intruded toner Tb, the process flag FP is set to "1" in step S18, whereby the subroutine is completed. The control system then starts a copying process by N-P development, for example, by engaging the clutch for rotating the developing sleeve.

Figure 13:
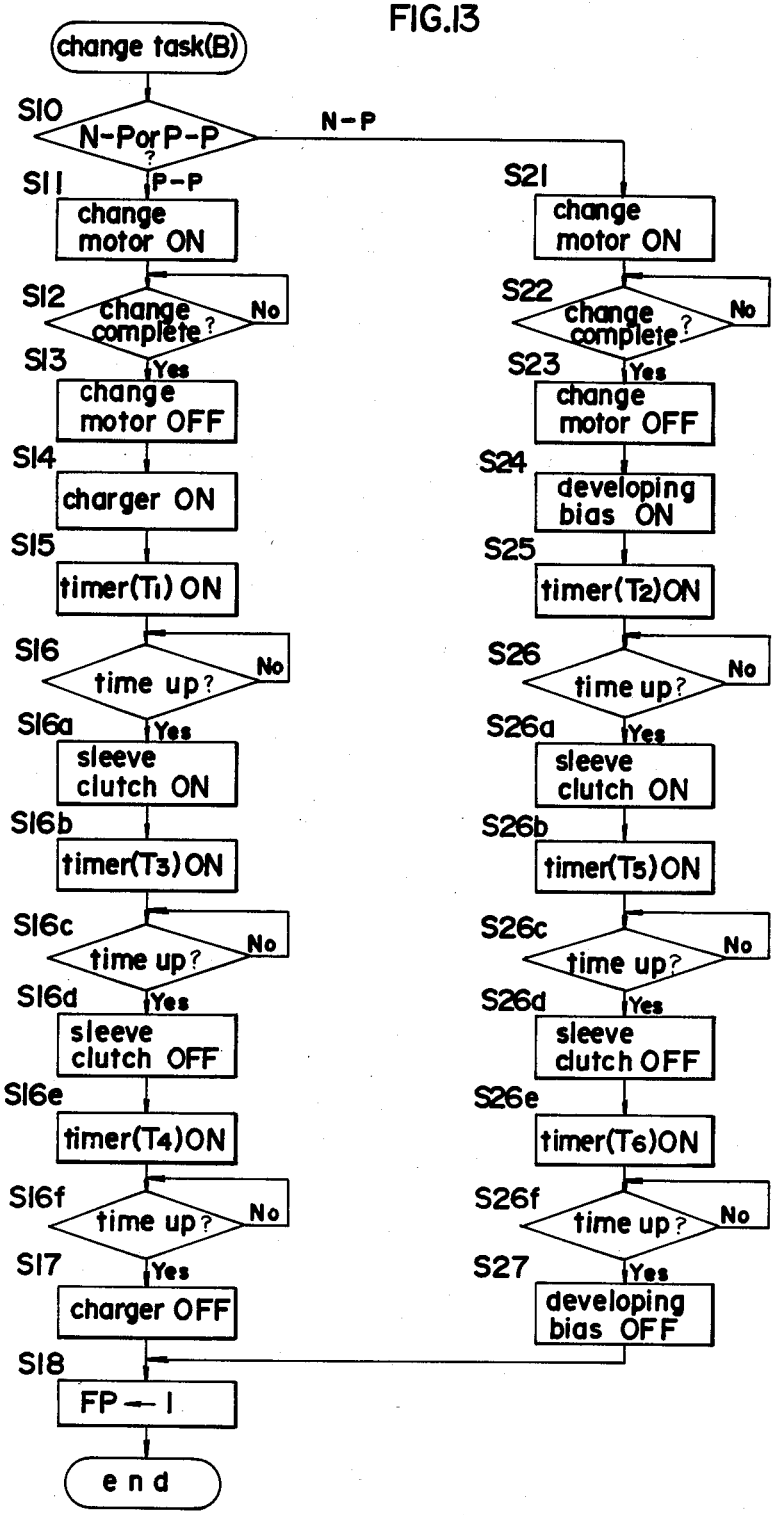
FIG. 13 is a flow chart showing a modification of the subroutine of FIG. 12.

FIG. 13 is a modification of the foregoing first embodiment, i.e., the subroutine of a change task B. Steps S10 to S16, as well as steps S21 to S26, are the same as those shown in FIG. 12

When P—P development is selected, completion of step S16 for removing the intruded toner Ta is followed by step S16*a* in which the clutch 45 is engaged to rotate the developing sleeve 21. A timer T3 is actuated in step S16*b*. The set time is up in step S16*c*, whereupon the clutch 45 is disengaged in step S16*d*. Thus, the developing sleeve 21 is rotated a small amount and stopped. When N-P development is selected, steps S26*a* to S26*d* are similarly executed after the completion of step S26 for removing the intruded toner Tb, whereby the developing sleeve 11 is rotated a small amount only for a period of time set on a timer T5. By the slight rotation of the developing sleeve 21 or 11, the developer portion from which the extraneous toner Ta or Tb has been removed by steps S14 to S16 or steps S24 to S26 is moved away from the developing station Yb or Ya. This procedure is necessary to position another developer portion adjacent to the above portion at the developing station Yb or Ya and to assure more complete removal of the intruded toner from the developer. Accordingly, the time set on the timer T3 or T5 is a period of time required for the first-mentioned developer portion to move away from the developing station a small distance through the rotation of the developing sleeve. Further in the case of P—P development, a timer T4 is turned on in step S16*e*. The set time is up in step S16*f*, whereupon the same steps S17 and S18 as above are executed. In the case of N-P development, a timer T6 is turned on in step S26*e*, and the set time is up in step S26*f*, which is followed by the same steps S27 and S28 as above. This procedure is intended to remove the extraneous toner, if any, from the developer portion newly positioned at the developing station by the steps S16*a* to S16*d* or steps S26*a* to S26*d*. Accordingly the time set on the timer T4 or T6 is a period of time required for removing the intruded toner.

Figure 14:
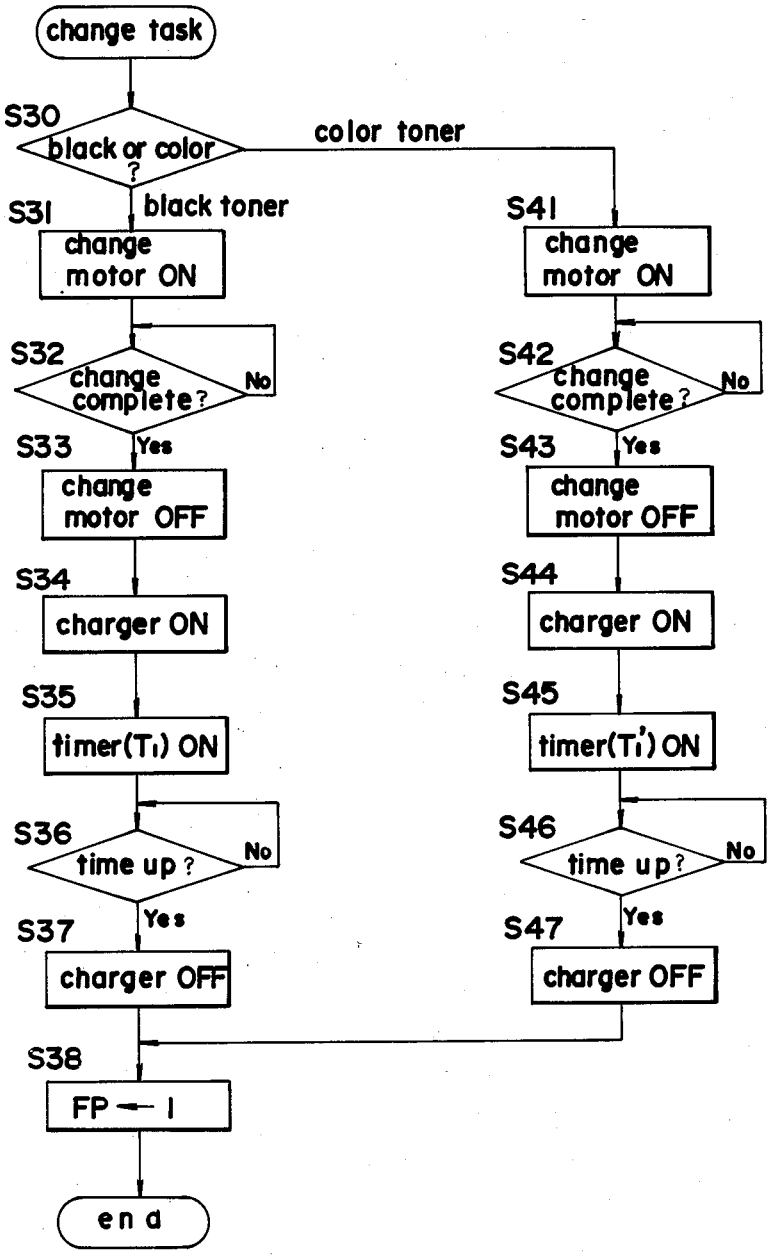
FIG. 14 is a flow chart showing another embodiment of change task of FIG. 12.

FIG. 14 shows the subroutine of a change task according to a second embodiment. With this embodiment, a developer containing a monochromatic toner such as red, blue or yellow is filled in the first developing unit, and a developer containing a black toner in the second developing unit 20, and one of the units 10 and 20 is selected for selectively developing with the color toner or black toner. In this case, both the toners are triboelectrically charged positively for normal P—P development.

The change task subroutine starts with step S30 which checks whether the black toner or the color toner is selected. When the result indicates that the black toner is selected, steps S31 et seq. are executed, whereas when the color toner is found selected, step S41 et seq. are executed. More specifically, steps S31 to S34, as well as steps S41 to S44, are the same as steps S11 to S14 described. With the present embodiment, each of the developing units 10 and 20 is used for P—P development, so that the sensitizing charger is turned on in step S34 (S44) to charge the surface of the drum 1 already in rotation to −600 V. When the black toner is selected, the timer T1 is turned on in step S35, or when the color toner is selected, a timer T1' is turned on. The set time is up in step S36 or S46, whereupon the sensitizing charger is turned off in step S37 or S47. At this time, the toner intruding into the developer at the developing station of the selected developing unit is removed along with the normal toner from the normal developer by adhering to the charged portion of the drum 1 and is further removed from the drum 1 by the cleaner. The time set on the timer T1 is the same as that set on the timer T1 in step S15. The time set on the other timer T1' is also substantially the same as that on the timer T1 but is slightly longer by an amount corresponding to the position of the first unit 10 relative to the unit 20 which is located downstream from the unit 10 with respect to the direction of rotation of the drum 1 (direction of arrow a). After the completion of removal of the intruded toner, the process flag FP is set to "1" in step S38, whereby the subroutine is completed.

The intruded toner is removed by the method of removing the intruded toner only selectively or by removing the intruded toner along with the normal toner as in the above embodiments. Although it appears that the latter method used for the embodiments will entail waste of the normal toner, the method nevertheless is advantageous because the amount of normal toner removed is small and because the intruded toner is removed completely. The former method may be practiced by applying a developing bias of −300 V to remove the negatively charged toner (intruded toner) only without sensitizing the drum by the sensitizing charger, instead of steps S13 to S16 of FIG. 12 for removing the intruded toner under the condition of adhering the positively charged toner (normal toner). In the case of N-P development, the surface of the drum 1 may be charged to −600 V by the sensitizing charger, with application of a developing bias of −300 V to the sleeve 11, to remove the positively charged toner (intruded toner) only, instead of steps S23 to S26 for the removal of the intruded toner under the condition of adhering the negatively charged toner (normal toner).

According to the embodiments described above, the developing sleeve of the developing unit not in use for development is moved away from the developing station with the developer thereon held at rest without movement, so that the toner scattering from the developing unit in operation, although intruding into the developer on the outer periphery of the sleeve of the other unit opposed to its developing station, remains only in the surface portion of the developer without further mixing therewith. The intruded toner can be reliably removed from the selected developing unit before its developing operation, for example, by causing the developer on the developing sleeve outer periphery at the developing station to adhere to an area other than the image forming area of the surface of the drum before the selected developing unit is initiated into operation.

The embodiments described above can be altered as will be described below.

For example, the process for removing the toner intruding into the developing unit not in use can be practiced according to the operation of the developing unit which has been in use. The control process to be practiced according to the developer unit operation can be executed in various modes as will be described with reference to the following embodiments. The process so executed eliminates the likelihood that the drum will be cleaned when actually unnecessary or will be cleaned to an extent more than is necessary.

The overall control process for the reader-printer, which is practiced as shown in FIG. 11, will not be described.

According to the following third embodiment, the depression of the print switch is followed by a series of control procedures as will be described with reference to the flow chart of FIG. 15.

First, step S70 checks which of N-P development and P—P development is selected. When N-P development is found selected, steps S71 et seq. are executed, while when the mode of development selected is N-P, steps S81 et seq. are executed. Step S71 (S81) checks whether a machine mode flag FMM is "1" or "0" to recognize which of the developing units 10 and 20 is in position for development. The machine mode flag FMM is set to "1" when the N-P development unit 10 is in position for development or to "0" when the P—P development unit 20 is in position. Accordingly, when the development mode detected by step S70 agrees with the position of the unit 10 or 20, a copying process is executed in the development mode selected. If otherwise, a process flag FP is reset to "0" in step S72 (S82), and the subroutine of change task D (C) to be described below in detail is performed in step S73 (S83), with a process weight assigned. Since the developing unit now selected is likely to contain the extraneous toner from the other unit which was in use, the process weight indicates to what extent the toner removal process is to be conducted in order to obviate unnecessary cleaning or excessive cleaning. Thus, a weight is assigned according to the operating conditions of the other developing unit in use, for example, the number of copies or operating time, as will be stated in detail below.

Before the start of copying process, parameters (operating conditions) are set in step S74 (S84) in conformity with the developing mode. Step S75 (S85) is then performed for a sequence of copying procedures. When the copying process is executed free of any trouble, step S76 (S86) follows in which to indicate the state of the unit 10 (20) in use, an N-P counter NC2 (P—P counter PC2) is advanced by "1" by a signal from the interface 73 of the microcomputer 70 given via the drive circuit 74. Next, an N-P counter NC1 (P—P counter PC 1) in the memory 71 is advanced by "1" in step S77 (S87). A total counter TC is further advanced by "1" in step S78.

For executing the copying operation, the sleeve of the selected developing unit is positioned in the developing station for use by the change motor 39, with the sleeve of the other developing unit held away from its developing station and out of rotation.

During development, some toner Ta or Tb scatters from the developing unit in operation and intrudes into the developer on the outer periphery of the sleeve of the other unit as already described with reference to FIG. 8 (*a*) or 9 (*b*). The intruded toner removal process to be practiced before the copying process will be described as a fourth embodiment.

Figure 16:
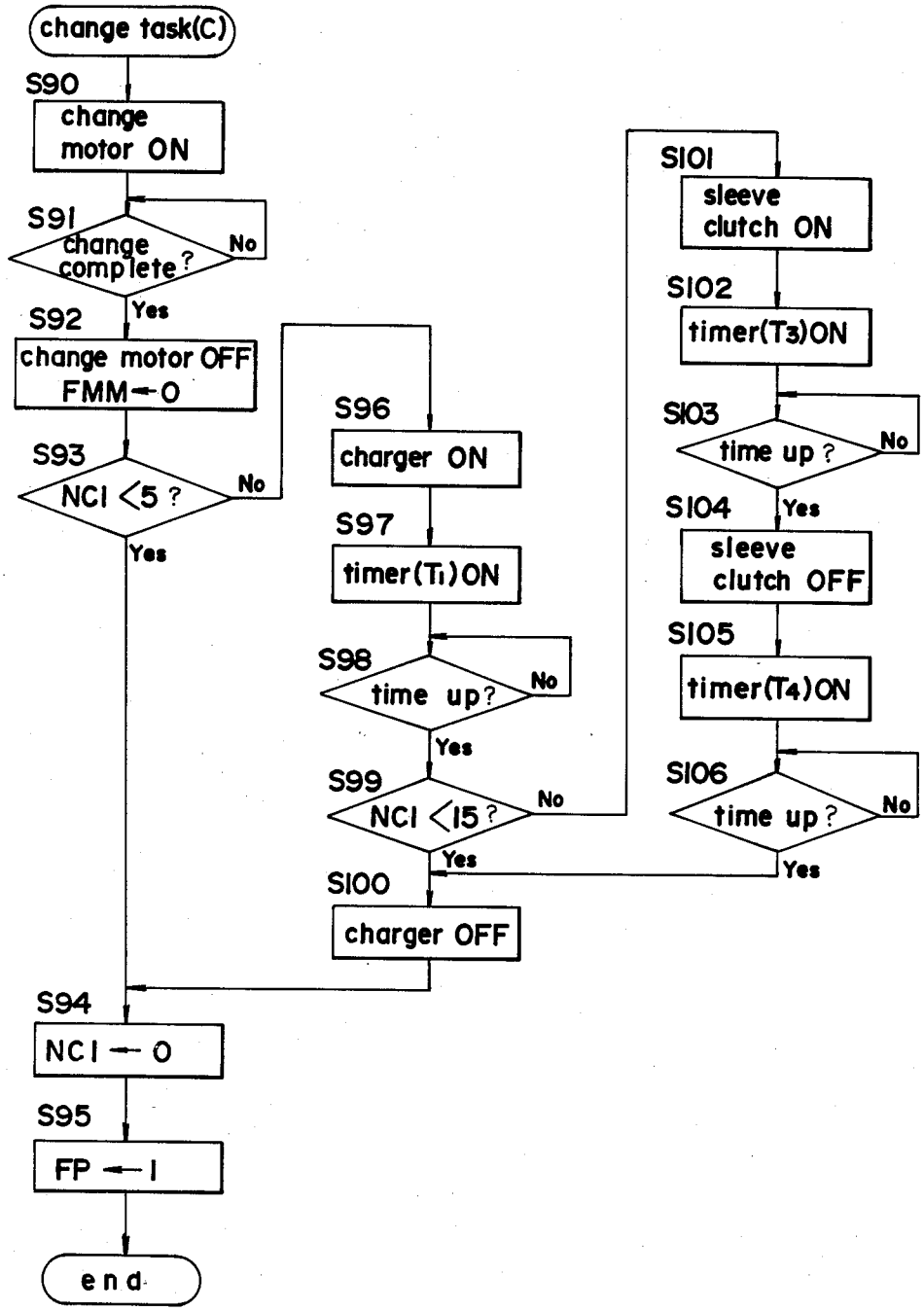
Figure 17:
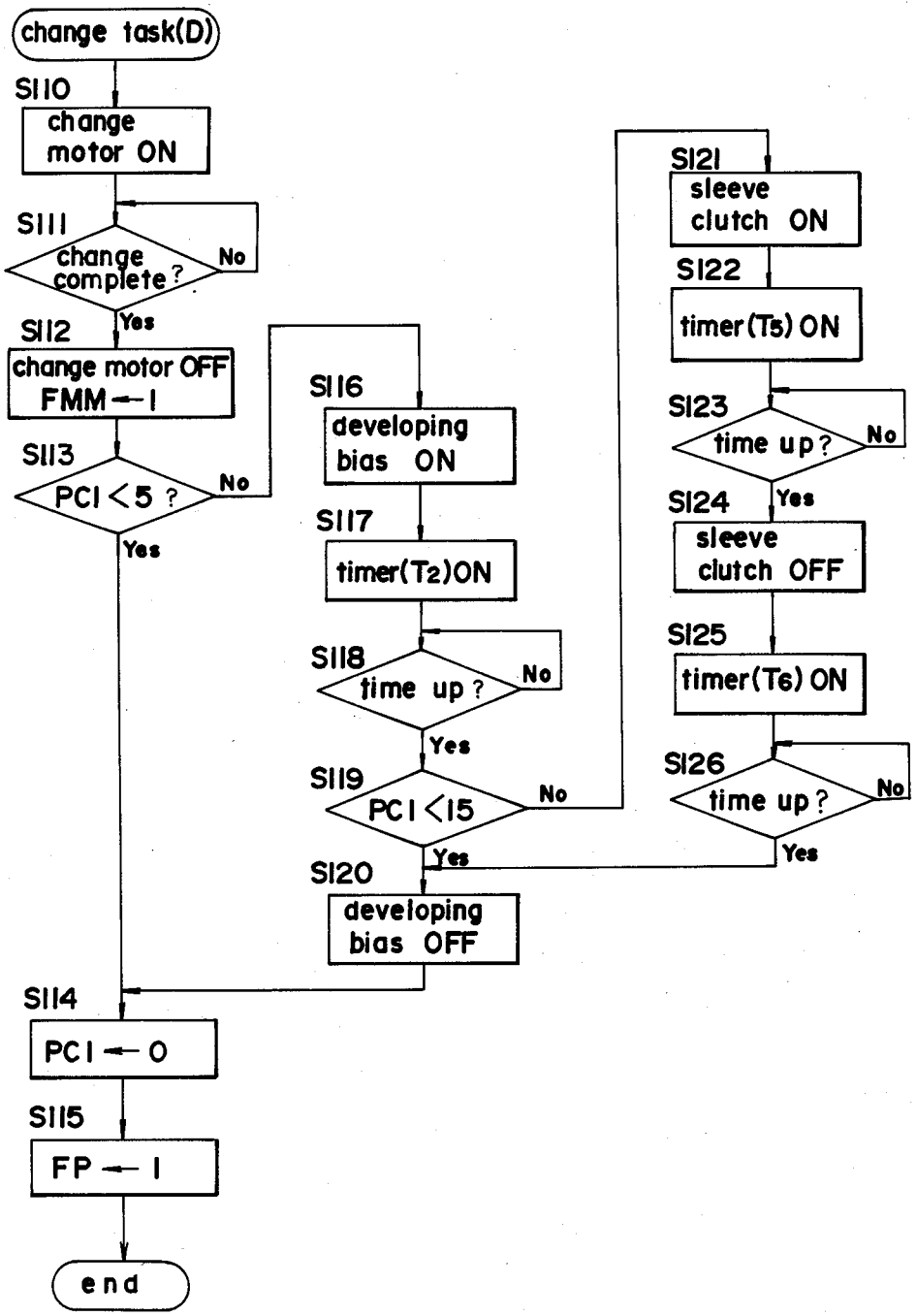

FIGS. 16 and 17 show the subroutines of change tasks C and D as specific examples of the process.

These subroutines are executed when the answer to the inquiries of steps S71 and S81 is NO, that is, when the selected developing mode is preceded by the other developing mode immediately therebefore. First, the change motor 39 is turned on in step S90 (S110). On completion of the change in step S91 (S111), the change motor 39 is turned off in step S92 (S112) in response to a signal from the position sensor 42 (43). The machine mode flag FMM is also set to "0" or "1" (see FIG. 8 (*b*) or 9 (*b*)).

Next, step S93 (S113) checks whether the count value of the counter NC1 (PC1) is smaller than "5". If the value is smaller than "5" (YES), the counter NC1 (PC1) is immediately reset to "0" in step S94 (S114), and the process flag FP is set to "1" in step S95 (S115), whereby the subroutine is completed without removing the intruded toner. Thus, the intruded toner removal process is not practiced when the copy number count of the preceding developing mode is less than "5", because the amount of scattering toner resulting from the development is so small as to be negligible and further because the removal process, if conducted, would entail waste of the developer.

On the other hand, if the count value of the counter NC1 (PC1) is not smaller than "5" (NO for step S93 or S113), the following steps are performed. In the case of P—P development, the sensitizing charger is turned on in step S96 to charge the surface of the drum 1 already in rotation to −600 V. The timer T1 is turned on in step S97, and the set time is up in step S98, whereupon step S99 checks whether the count value on the counter NC1 is smaller than "15". If it is smaller, the charger is turned off in step S100. At this time, the toner Ta intruding into the developer positioned at the developing station for the second developing unit 20 for P—P development is removed along with the normal toner from the outer periphery of the sleeve 21 at rest by adhering to the charged area of the drum 1 (see FIG. 8 (*c*)). The toner is then removed from the drum 1 by the unillustrated cleaner. The time set on the timer T1 is a period of time taken for a point on the drum 1 to move from the position of the sensitizing charger to the developing station, plus a period of time required for removing the intruded toner. On completion of the removal of the intruded toner Ta, the counter NC1 is reset to "0" in step S94, and the process flag FP is set to "1" in step S95, whereby the subroutine is completed. The control system then starts a copying process by P—P development, for example, by engaging the clutch for rotating the developing sleeve.

For N-P development, on the other hand, the developing bias source is turned on in step S116 to apply a developing bias of −500 V to the developing sleeve 11 of the first developing unit 10 for N-P development, with the drum 1 already in rotation. The timer T2 is turned on in step S117, and the set time is up in step S118, whereupon step S119 checks whether the count value on the counter PC1 is smaller than "15". If it is smaller, the bias source is turned off in step S120. At this time, the toner Tb intruding into the developer positioned at the developing station for the first unit 10 for N-P development is removed along with the normal toner from the outer periphery of the developing sleeve 11 at rest by adhering to the unsensitized drum 1. Thus, the extraneous toner is removed from the normal developer (see FIG. 9 (*c*)) and further from the drum 1 by the unillustrated cleaner. The time set on the timer T2 is a period of time required for removing the intruded toner as in the first embodiment. On completion of the removal of the intruded toner Tb, the counter PC1 is reset to "0" in step S114, and the process flag FP is set to "1" in step S115, whereby the subroutine is completed. The control system then starts a copying process by N-P development, for example, by engaging the developing sleeve rotating clutch.

When the count value on the counter NC1 is found to be not smaller than "15" by step S99, completion of step S98 for removing the intruded toner Ta is followed by step S101 in which the sleeve clutch 45 is engaged to rotate the developing sleeve 21. The timer T3 is actuated in step S102, and the set time is up in step S103, whereupon the clutch 45 is disengaged in step S104. Thus, the sleeve 21 is rotated a small amount and stopped. When the count value on the counter PC1 is found to be not smaller than "15" by step S119, steps S121 to S126 are similarly executed after the completion of step S118 for removing the intruded toner Tb, whereby the developing sleeve 11 is rotated a small amount only for a period of time set on the timer T5. By the slight rotation of the developing sleeve 21 or 11, the developer portion from which the intruded toner Ta or Tb has been removed by steps S96 to S98 or steps S116 to S118 is moved away from the developing station Yb or Ya. This procedure is necessary to position another developer portion adjacent to the above portion at the developing station Yb or Ya and to assure more complete removal of the intruded toner from the developer. Accordingly, the time set on the timer T3 or T5 is a period of time required for the first-mentioned developer portion to move away from the developing station a small distance through the rotation of the developing sleeve as in the first embodiment. Further in the case of P—P development, the timer T4 is turned on in step S105, and the set time is up in step S106, whereupon the same steps S94 and S95 as above are executed.

In the case of N-P development, the timer T6 is actuated in step S125, and the set time is up in step S126, which is followed by the same steps S114 and S115 as above. This procedure is intended to remove the intruded toner, if any, from the developer portion newly positioned at the developing station by the steps S101 to S104 or steps S121 to S124. Accordingly, the time set on the timer T4 or T6 is a period of time required for removing the intruded toner.

When the number of copies prepared in the preceding developing mode is not smaller than 5, not only the developer positioned at the developing station but also another developer portion, as transported to the developing station by slightly rotating the sleeve, is treated to remove the intruded toner since when the developing operation is repeated many times, a large amount of toner scatters to considerably contaminate the developing unit at rest, such that the intruded toner is not fully removable by treating only the developer at the developing station.

The third and fourth embodiments are control processes for the image forming apparatus when the first developing unit 10 is used for N-P development and the second developing unit 20 for P—P development. The control process needs some modifications when the unit 10 is filled with a developer containing a monochromatic toner such as red, blue or yellow toner, with the unit 20 filled with a developer containing a black toner, to selectively use one of the units 10 and 20 for color toner development or black toner development.

Figure 15:
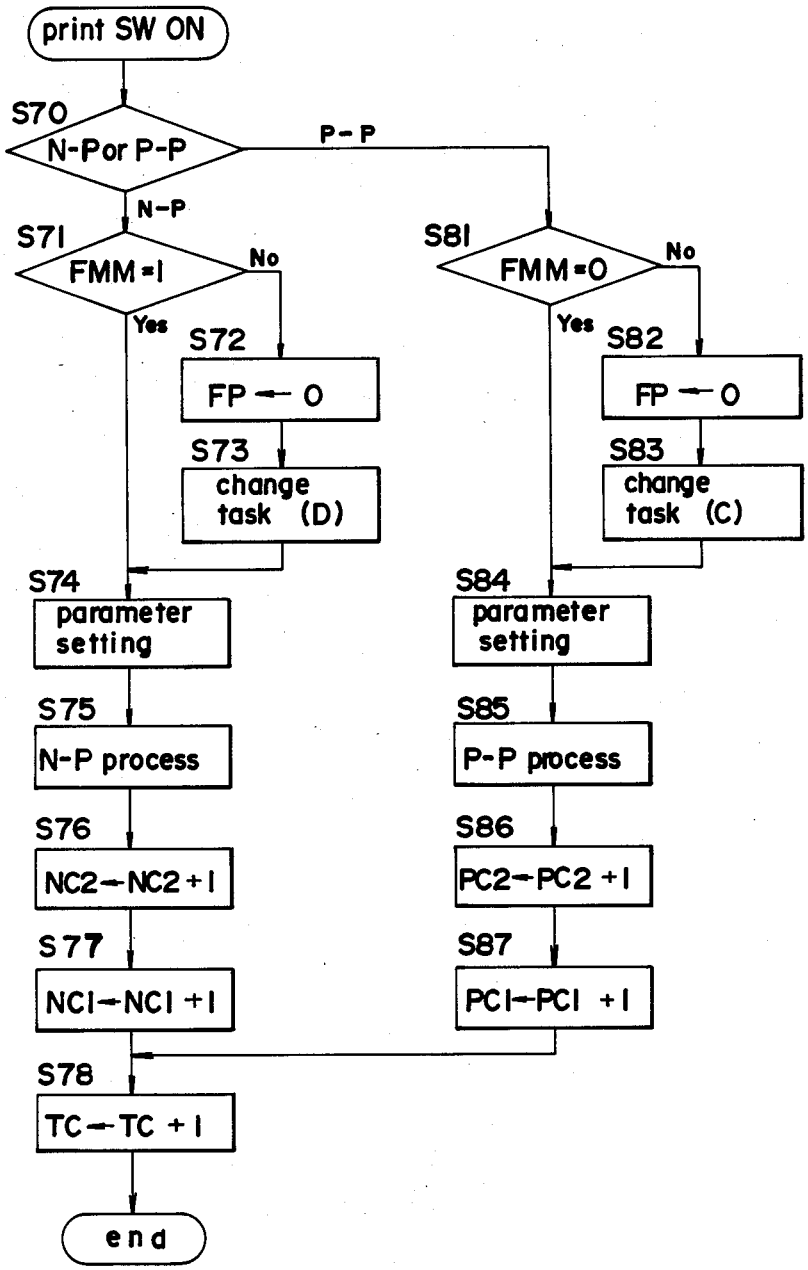
FIGS. 15 to 17 are flow charts showing another embodiment.

Stated more specifically, step S70 in FIG. 15 needs to be changed to an inquiry as to black or color development. Further when the apparatus is adapted for selective development with the color toner or the black toner, the development is conducted in P—P mode in either case, so that there arises the need to change the application of developing bias in step S116 of FIG. 17 to the energization of the sensitizing charger and to change the off action on the bias source in step S120 to the deenergization of the sensitizing charger. In connection with this, the actuation of the timer T2 in step S117 of FIG. 17 must be changed to the actuation of the timer T1.

According to the third or fourth embodiment described, the intruded toner removal process involves weighting in accordance with the state of the other developing unit previously in operation. With the third embodiment, no toner removal process is practiced when the number of developing cycles of the other developing unit is less than 5 with a very small amount of intruded toner, the intruded toner at the developing station is removed when the cycle number is 5 to 15, or the intruded toner at the upstream side of the developing station is also removed when the cycle number exceeds 15 entailing intrusion of an increased amount of extraneous toner. Such a weight is only an example; weighting may be done according to the copy size, or a greater weight may be given to the removal process for the unit at the lower stage which is more susceptible to the intrusion of extraneous toner. The period of time to be set on the timer T2, T3, T5 or the like may be variable according to the weight.

According to the embodiments described, before the selected developing unit starts its operation, the toner released onto the developing sleeve outer periphery at the developing station from the other unit is removable by cleaner means according to a weight in conformity with the state of operation of the other unit, with the result that the intruded toner can be removed from the selected unit reliably, while the weighting obviates unnecessary or excessive removal of intruded toner.

Next, the control process of an embodiment will be described in which the intruded toner removal process is practiced automatically upon detecting that the current operation of the selected developing unit has produced a predetermined amount of copying. This process eliminates the likelihood that an amount of intruded toner more than is removable will remain in the developing unit not in use, making it possible to reliably remove the intruded toner even if the selected unit only is continuously used for a large number of developing cycles.

The control process will be described with reference to the flow charts of FIGS. 11 and 18 to 24 and the diagrams of FIGS. 8 and 9.

The overall control process for the reader-printer, which is as shown in FIG. 11 and already described in detail, will not be described again.

Figure 18:
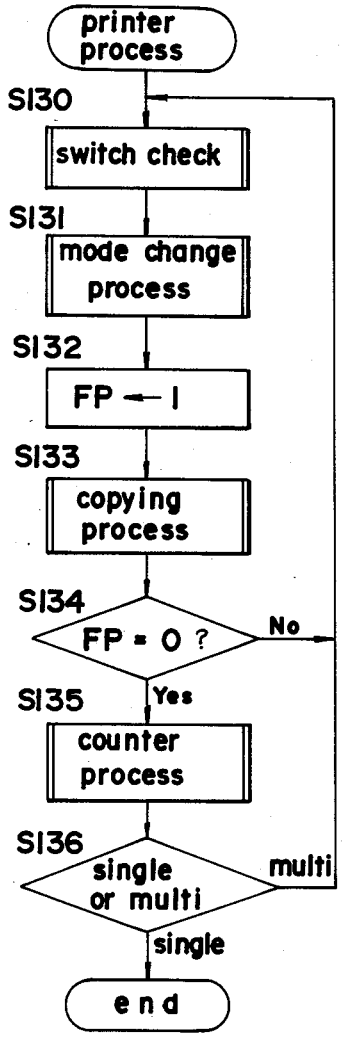
FIGS. 18 to 22 are flow charts showing another embodiment.

FIG. 18 shows a sequence of control procedures following the depression of the print switch.

First, step S130 executes the subroutine of checking various switches (not shown) for detecting the state of copy paper and various switches (not shown) for detecting the state of the image projecting optical system. Step S131 checks whether the selected developing mode, N-P development or P—P development, is in agreement with the developing unit (10 or 20) in position for development, and if agreement is found, this step is completed. If otherwise, a subroutine is executed in preparation for a copying process by shifting the developing unit 10 or 20 and removing the intruded toner. The process flag FP is set to "1" in step S132, making the machine ready for copying process.

Next, the copying process is executed in step S133 with the sequence of sensitization, exposure, development, transfer, separation of copy paper, fixing, etc. When one copy is completed, the subroutine of resetting the process flag FP to "0" is executed. Step S134 checks whether the process flag FP is "0", i.e., whether one copying cycle is completed. When it is "0" (YES), the next step S135 follows, whereas if it is "1" (NO), the sequence returns to step S130. In step S135, a counter process is executed by advancing the total counter, N—P counter or P—P counter. When a preset number of copies are made by the continuous operation of the developing unit 10 or 20, the subroutine of removing the intruded toner is executed for the other developing unit 20 or 10. Step S136 checks whether the operation is for making a single copy or a multiplicity of copies (multi, continuous copying). If the answer is multi, the sequence returns to step S130. The answer, if single, indicates completion of the printer process. Step S2 of FIG. 11 then follows.

For the copying process of step S133, the sleeve of the selected developing unit is positioned by the change motor 39 at the developing station and is used for development, with the sleeve of the other unit held away from the developing station and out of rotation. During development, however, some toner Ta or Tb scatters from the unit in use and intrudes into the developer on the outer periphery of the sleeve of the other unit as shown in FIG. 8(*a*) or 9(*b*) and already described.

Figure 20:
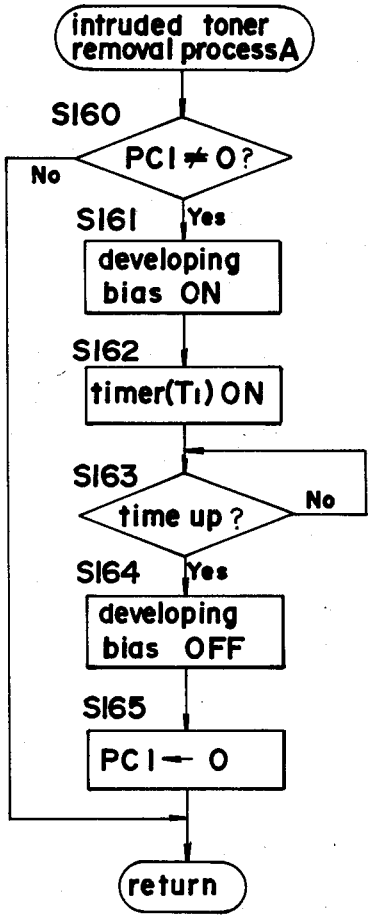
Figure 21:
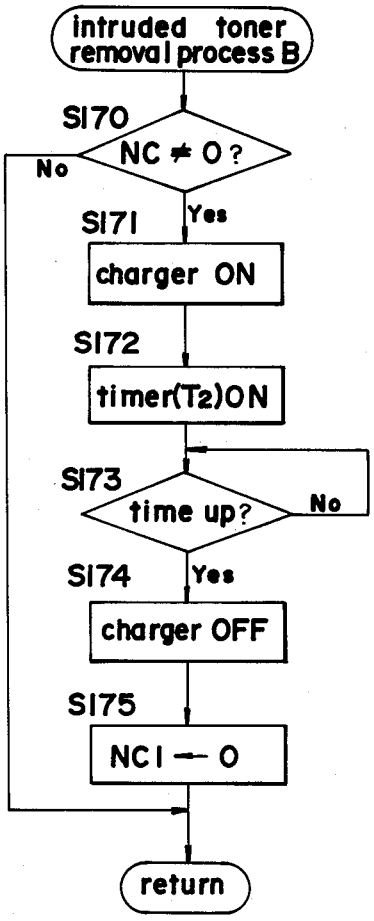

The developing mode change process to be executed before the execution of copying process will be described as a fifth embodiment of the invention with reference to FIGS. 19, 20 and 21.

Figure 19:
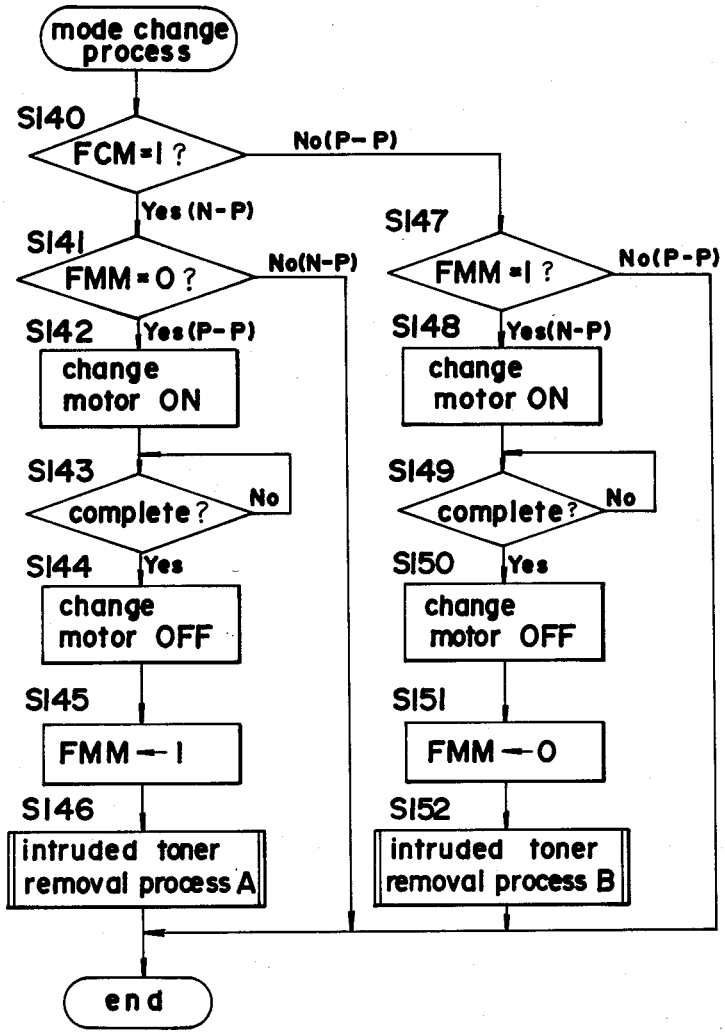

As shown in FIG. 19, step S140 checks whether a development mode flag FCM is set to "1", namely, whether N—P development is selected. The flag FCM is set to "1" when N—P development is selected in step S4, or is reset to "0" when P—P development is selected. When N—P development is found selected in step S140 (YES), steps S141 et seq. are performed, whereas steps S147 et seq. are executed when the answer is P—P development (NO). More specifically, step S141 (S147) checks whether the machine mode flag FMM is "0" or "1" and recognizes which of the units 10 and 20 is in position for development. When the development mode detected by step S140 agrees with the developing unit 10 (20) in position, a copying process is executed in the selected developing mode. If otherwise, the change motor 39 is turned on in step S142 (S148). On completion of the change in step S143 (S149), the change motor 39 is turned off in step S144 (S150) in response to a signal from the position sensor 42 (43). The machine mode flag FMM is inverted to "1" or "0" in step S145 (S151) (see FIG. 8(*b*) or 9(*b*)).

Subsequently, the subroutine of intruded toner removal process A (B) shown in FIG. 20 (21) is executed in step S146 (S152).

More specifically, step S160 (S170) checks whether the counter PC1 (NC1) has a value other than "0". These counters PC1 and NC1 are those on the memory 71 for temporarily storing the number of copies made in the preceding developing mode. The counter PC1 counts the number of copies by P—P development, while the counter NC1 counts the number of copies by N—P development. The memory 71 is backed up by a battery for protecting the stored data while the power supply is off.

When step S160 (S170) finds the count value to be "0" (NO), the subroutine of intruded toner removal process and the change task process are completed without practicing the removal process. On the other hand, if the count value of the counter PC1 (NC1) is greater than "0" (YES), the following steps are performed. For N—P development, the developing bias source is turned on in step S161 to apply a developing bias of −500 V to the developing sleeve 11 of the first developing unit 10 for N—P development, with the drum 1 already in rotation. A timer T1 is turned on in step S162, and the set time is up in step S163, whereupon the bias source is turned off in step S164. At this time, the toner Tb intruding into the developer position at the developing station Ya for the first developing unit 10 for N—P development is removed along with the normal toner from the outer periphery of the developing sleeve 11 at rest by adhering to the unsensitized drum 1. Thus, the intruded toner is removed from the normal developer (see FIG. 9(*c*)) and further from the drum 1 by the unillustrated cleaner. The time set on the timer T1 is a period of time required for removing the intruded toner. On completion of the removal of the intruded toner Tb, the counter PC1 is reset to "0" in step S165, whereby the current subroutine, as well as the change task process, is completed.

For P—P development, the sensitizing charger is turned on in step S171 to charge the surface of the drum 1 already in rotation to −600 V. A timer T2 is turned on in step S172. When the set time is up in step S173, the charger is turned off in step S174. At this time, the toner Ta intruding into the developer positioned at the developing station Yb for the second developing unit 20 for P—P development is removed along with the normal toner from the outer periphery of the developing sleeve 21 at rest by adhering to the charged area of the drum 1 (see FIG. 8(*c*)). The toner is then removed from the drum 1 by the unillustrated cleaner. The time set on the timer T2 is a period of time taken for a point on the drum 1 to move from the position of the sensitizing charger to the developing station Yb plus a period of time required for removing the intruded toner. On completion of the removal of the intruded toner Ta, the counter NC1 is reset to "0" in step S175, whereby the current subroutine, as well as the change task process, is completed.

When the subroutine of mode change process is thus completed, the process flag FP is set to "1" in step S132, and a copying process is started in the developing mode concerned in step S133, for example, by engaging the developing sleeve rotating clutch. Parameters (operating conditions) are set according to the selected developing mode for starting the copying process, and a sequence of copying procedures is executed. When one copying cycle is completed without trouble, the process flag FP is reset to "0". When the process flag FP is found reset to "0" in step S134 as already stated, the counter process to be described below in detail is executed in step S135.

Figure 22:
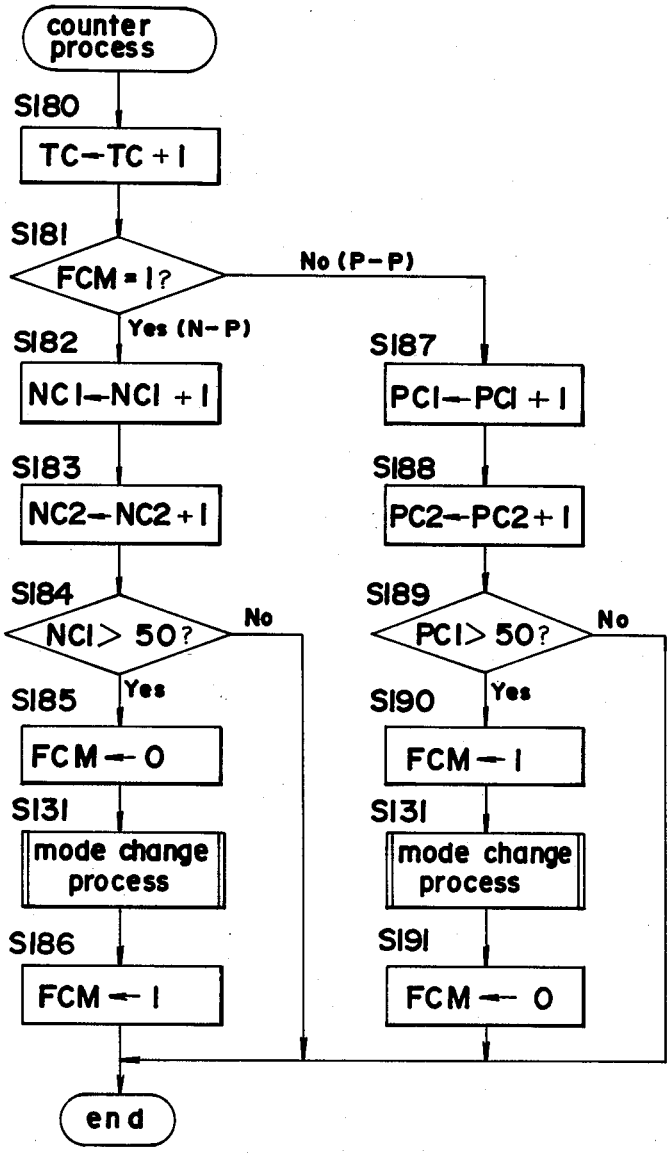

The subroutine of the counter process will be described in detail with reference to FIG. 22.

On completion of the copying process free of any trouble, the microcomputer 70 advances the total counter TC by "1" through the interface 73 and the drive circuit 74 in step S180. Step S181 checks whether the developing mode flag FCM is set to "1". When N—P development is selected, i.e., when the flag is set to "1" (YES), steps S182 et seq. are performed. If P—P development is selected, i.e., when the flag is set to "0" (NO), steps S187 et seq. are executed.

The counter NC1 (PC1) on the memory 71 is advanced by "1" in step S182 (S187). In step S183 (S188), a counter NC2 (PC2) for indicating the state of the developing unit 10 (20) is advanced by "1" by the microcomputer 70 via the interface 73 and the drive circuit 74. Next, step S184 (S189) checks whether the count value of the counter NC1 (PC1) is greater than "50". If N—P development and P—P development are alternately conducted frequently, the count value will not be greater than "50" since the counter PC1 (NC1) is reset to "0" in step S165 (S175). However, if only on of the developing units is continuously used for copying, the copy number count of "50" preset in the present embodiment will be exceeded.

When the count value of the counter NC1 (PC1) is up to "50" (NO for step S184 (S189)), the current subroutine is completed, whereas if the value is not smaller than "51" (YES to the inquiry of step S184 (S189)), steps S185 (Sl90) et seq. are executed. In step S185 (S190), the developing mode flag FCM is inverted to "0" ("1"), followed by step S131 to execute the subroutine of mode change process.

More specifically, the following steps are performed for N—P development. Since the developing mode flag FCM is reset to "0" in step S185, with the machine mode flag FMM set to "1" in step S145, steps S148 et seq. are executed to shift the developing unit 20 to the developing position, and the machine mode flag FMM is inverted to "0" in step S151. In the subroutine of intruded toner removal process B of step S152, "51" is set in the counter NC1, so that steps S171 et seq. for the intruded toner removal process are executed. The counter NC1 is reset to "0" in step S175. On completion of the mode change process, the developing mode flag FCM is set to "1" in step S186, whereby the current subroutine of counter process is completed.

Subsequently when N—P development is selected for copying, the development mode flag FCM is already set to "1" in step S186, with the machine mode flag FMM reset to "0" in step S151, so that the inquiries of steps S140 and S141 are answered by YES. Steps S142 to S144 then follow, shifting the developing unit 10 to the developing position. The machine mode flag FMM is set to "1" in step S145, which is to be followed by step S146 of intruded toner removal process A. Nevertheless, the developing counter PC1 is already reset to "0" by the preceding process of P—P development, with the result that the inquiry of step S160 is answered with NO. The removal process of steps S161 et seq. is not executed therefore. The process flag FP is set to "1" in step S132 to execute a copying process.

In the cas of P—P development, the developing mode flag FCM is already set to "1" in step S190, with the machine mode flag FMM reset to "0" in step S151, so that steps S142 et seq. are executed to shift the developing unit 10 to the developing position, and the flag FMM is inverted to "1" in step S145. This step is followed by the subroutine of intruded toner removal process A of step S146. Since the counter PC1 is set to "51", the intruded toner removal process of steps S161 et seq. is executed. The counter PC1 is reset to "0" in step S165. On completion of the mode change process, the developing mode flag FCM is reset to "0" in step S191, whereby the current subroutine of counter process is completed.

When P—P development is subsequently selected for copying, the developing mode flag FCM is already set to "1" in step S191, with the machine mode flag FMM reset to "0" in step S145, so that step S140 is answered with NO, and step S147 with YES. Steps S148 to S150 are then executed to shift the developing unit 20 to the developing position. The machine mode flag FMM is reset to "0" in step S151, which is to be followed by step S152. Nevertheless, the developing counter NC1 is already reset to "0" by the preceding process of N—P development. Consequently, the answer to the inquiry of step S170 is NO, and the intruded toner removal process of steps S171 et seq. is not practiced. The process flag FP is set to "1" in step S132 to execute a copying process.

Next, a sixth embodiment of the present invention will be described with reference to FIGS. 23 and 24. The intruded toner removal processes A' and B' of the sixth embodiment are improvements of the subroutines of intruded toner removal processes A and B of the fifth embodiment and involve weighting according to the number of copies.

Step S200 (S220) checks whether the count value of the counter PC1 (NC1) is greater than "5". If the value is up to "5" (NO), the counter PC1 (NC1) is immediately reset to "0" in step S206 (S226), whereby the subroutine is completed without removing the intruded toner. Thus, the intruded toner removal process is not practiced when the copy number count of the preceding developing mode is up to "5", because the amount of scattering toner resulting from the development is so small as to be negligible and further because the removal process, if practiced, would entail waste of the developer.

On the other hand, if the count value of the counter PC1 (NC1) is greater than "5" (YES for step S200 (S220)), the following steps are performed. In the case of N—P development, the developing bias source is turned on in step S20l to apply a developing bias of −500 V to the developing sleeve 11 of the developing unit 10 for N—P development, with the drum 1 already in rotation. A timer T1 is turned on in step S202, and the set time is up in step S203, whereupon step S204 checks whether the count value on the counter PC1 is smaller than "15". If it is smaller (YES), the bias source is turned off in step S205. At this time, the toner Tb intruding into the developer positioned at the developing station Ya for the developing unit 10 for N—P development is removed along with the normal toner from the outer periphery of the developing sleeve 11 at rest by adhering to the unsensitized drum 1. Thus, the intruded toner is removed from the normal developer (see FIG. 9(*c*)) and further from the drum 1 by the unillustrated cleaner. The time set on the timer T1 is a period of time required for removing the intruded toner. On completion of the removal of the intruded toner Tb, the counter PC1 is reset to "0" in step S206, whereby the subroutine is completed. The control system then starts a copying process by N—P development, for example, by engaging the sleeve rotating clutch.

Further in the case of P—P development, the sensitizing charger is turned on in step S221 to charge the surface of the drum 1 already in rotation to −600 V. A timer T2 is turned on in step S222, and the set time is up in step S223, whereupon step S224 checks whether the count value on the counter NC1 is smaller than "15". If it is smaller (YES), the charger is turned off in step S225. At this time, the toner Ta intruding into the developer positioned at the developing station Yb for the developing unit 20 for P—P development is removed along with the normal toner from the outer periphery of the sleeve 21 at rest by adhering to the charged area of the drum 1 (see FIG. 8(*c*)). The toner is then removed from the drum 1 by the unillustrated cleaner. The time set on the timer T2 is a period of time taken for a point on the drum 1 to move from the position of the sensitizing charger to the developing station, plus a period of time required for removing the intruded toner. On completion of the removal of the intruded toner Ta, the counter NC1 is reset to "0" in step S226, whereby the subroutine is completed. The control system then starts a copying process by P—P development, for example, by engaging the sleeve rotating clutch.

When the count value on the counter PC1 is found to be not smaller than "15" by step S204 (NO) for N—P development, completion of step S203 for removing the intruded toner Tb is followed by step S207 in which the sleeve clutch 45 is engaged to rotate the developing sleeve 11. A timer T3 is actuated in step S208, and the set time is up in step S209, whereupon the clutch 45 is disengaged in step S210. Thus, the sleeve 11 is rotated a small amount and stopped. When the count value on the counter NC1 is found to be not smaller than "15" by step S224 (NO) in the case of P—P development, steps S227 to S230 are similarly executed after the completion of step S223 of removing the intruded toner Ta, whereby the developing sleeve 21 is rotated a small amount only for a period set on a timer T5.

By the slight rotation of the developing sleeve 11 or 21, the developer portion from which the intruded toner Tb or Ta has been removed by steps S201 to S203 or steps S221 to S223 is moved away from the developing station Ya or Yb. This procedure is necessary to position another developer portion adjacent to the above portion at the station Ya or Yb and to assure more complete removal of the intruded toner from the developer. Accordingly, the time set on the timer T3 or T5 is a period of time required for the first-mentioned developer portion to move away from the developing station Ya or Yb a small distance through the rotation of the sleeve 11 or 21. Further in the case of N—P development, a timer T4 is turned on in step S221, and the set time is up in step S212, whereupon the same steps S205 and S206 as above are performed. In the case of P—P development, a timer T6 is actuated in step S231, and the set time is up in step S232, which is followed by the same steps S225 and S226 as above. This procedure is intended to remove the intruded toner, if any, from the developing portion newly positioned at the developing station by steps S207 to S210 or steps S227 to S230. Accordingly, the time set on the timer T4 or T6 is a period of time required for removing the intruded toner.

The foregoing steps S208, S210 and steps S228, S230 have been described with the developing sleeves 11, 21 rotated in the direction of arrow b. However, insofar as the developing sleeve 21 at the lower stage is concerned, the extraneous toner intrudes into the developing station Yb at the upstream side thereof, so that the sleeve may be rotated in steps S228 to S230 slightly in a direction opposite to the arrow b so as to reduce the amount of rotation needed.

According to the sixth embodiment described, unnecessary toner removal process is not conducted when the number of copies produced in the preceding developing mode is up to 5, whereas when the number of copies is not smaller than 15, not only the developer positioned at the developing station but also another developer portion, as transported to the developing station by slightly rotating the sleeve, is treated for removing the intruded toner, since when the developing cycle is repeated many times continually, an increased amount of extraneous toner scatters and intrudes into the unit and is not fully removable by treating only the developer at the developing station.

The fifth and sixth embodiments described are control processes for the image forming apparatus wherein the first developing unit 10 is used for N—P development and the second developing unit 20 for P—P development. The control process needs some modifications when the first unit 10 is filled with a developer containing a monochromatic toner such as red, blue or yellow toner, with the second unit 20 filled with a developer containing a black toner, to selectively operate one of the units 10 and 20 for color toner development or black toner development.

More specifically stated, step S140 in FIG. 19 needs to be changed to an inquiry as to black or color development. Further when the apparatus is adapted for selective development with the color toner or the black toner, the development is conducted in P—P mode in either case, so that there arises the need to change the application of developing bias in step S161 of FIG. 20 to the energization of the sensitizing charger and to change the off action on the bias source in step S164 to the deenergization of the sensitizing charger. In connection with this, the actuation of the timer T1 in step S162 of FIG. 20 must be changed to the actuation of the timer T2.

Further when the image forming apparatus is adapted for the selective development with a monochromatic toner or black toner selectively using one of the first and second units 10 and 20, charged with a developer containing the color toner and a developer containing the black toner respectively, the intruded toner removal process may be conducted with weighting according to not only the number of copies but also the up-down relation between the developing units 10 and 20. The fifth and sixth embodiments shown in FIGS. 19 to 24 must then be modified as follows.

Figure 23:
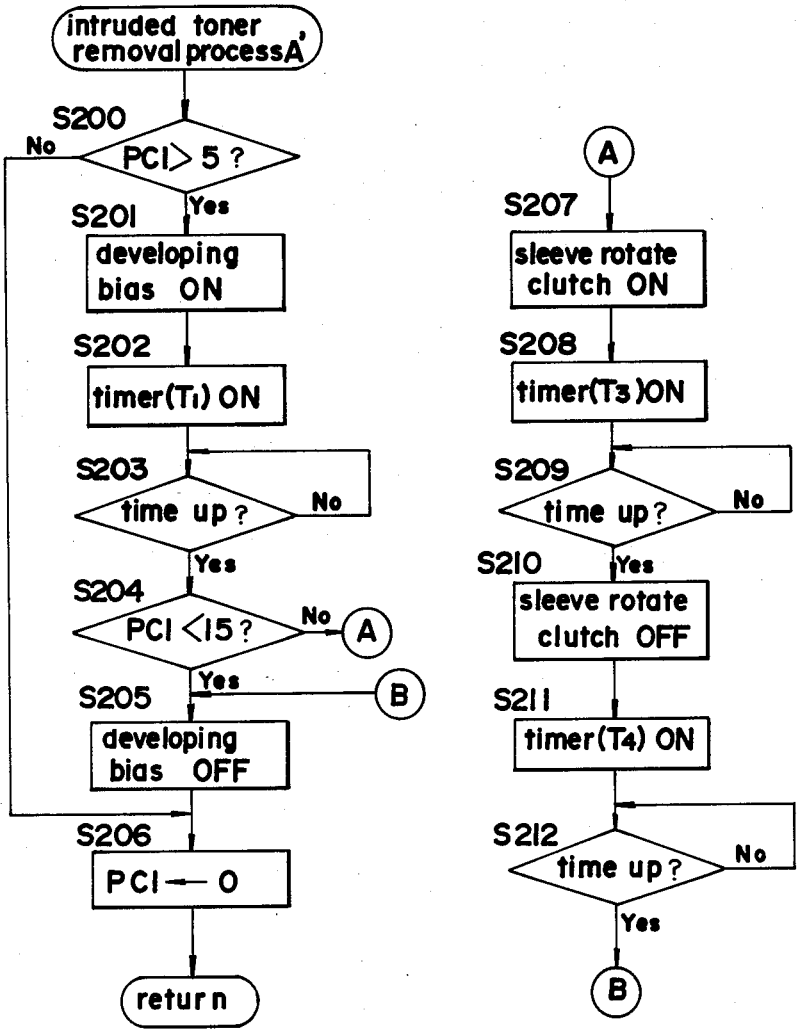
FIGS. 23 and 24 are flow charts showing another embodiment.

The checking step S200 of FIG. 23 must be modified to checking whether the counter value resulting from the preceding black toner development is greater than 5, for example, greater than 10. When the number of copies obtained in the preceding copying mode is up to "10", no intruded toner removable process is practiced because, as already described with reference to the sixth embodiment, a small number of developing cycles result in only a small amount of scattering toner which is negligible and further because the removal process, if practiced in such a case, will entail waste of the developer. The weights of "10" and "5" are given to the developing units 10 and 20 in view of the up-down relation therebetween since there is a difference therebetween in the scattering state of the toner.

When the apparatus is adapted for selective development with the color toner o black toner, P—P development is conducted in either case as already described, so that it is necessary to change the actuation of the developing bias source in step S201 of FIG. 23 to the energization of the sensitizing charger and to change the off action on the bias source in step S205 to the deenergization of the sensitizing charger. In connection with this, the actuation of the timer T1 in step S202 of FIG. 23 must be changed to the actuation of the timer T2.

Further the count value of the counter in step S204 needs to be checked as to whether it is greater than 15, for example, 30. Thus when the number of copies obtained in the preceding developing mode is greater than 30 or 15, not only the developer at the developing station but also another developer portion, as transported to the developing station by slightly rotating the sleeve, is treated for removing the intruded toner as described with reference to the sixth embodiment, since when the developing cycle is repeated many times, an increased amount of extraneous toner scatters and intrudes into the unit and is not fully removable by treating only the developer at the station. Even in this case, the developing units 10 and 20 are assigned weights according to the up-down relation therebetween.

Thus, some of the embodiments described above are so adapted that when the operation of the selected developing unit has resulted in at least a predetermined amount of copying, the toner intruding into the unselected developing unit is removed. This precludes the likelihood that even when only one unit is selected for continuous use, an amount of intruded toner more than is removable will remain in the other unit, assuring reliable removal of the intruded toner.

Finally, a control process will be described in which the intruded toner removal process is executed in accordance with the position relation between the developing units.

This control process is practiced based on the foregoing fifth and sixth embodiments. As to the overall control process for the reader-printer, the same control steps as shown in FIG. 18 are performed in sequence, following the depression of the print switch in the process of FIG. 11.

Figure 25:
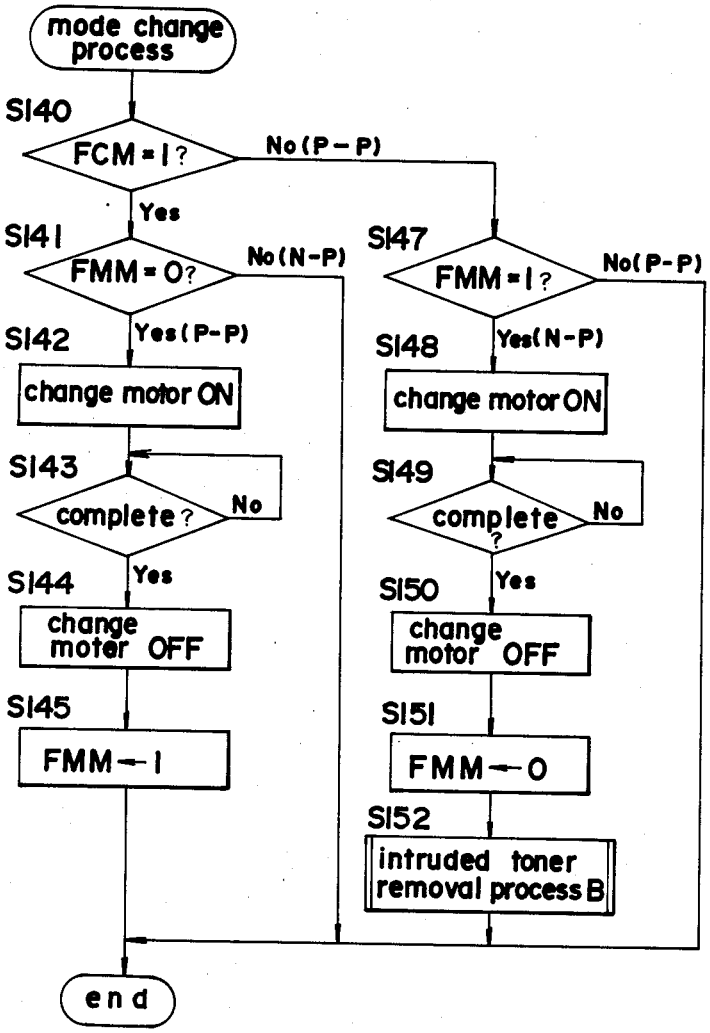
FIGS. 25 and 26 are flow charts showing another embodiment.

The mode change process to be executed for changing the developing mode before the execution of copying process will be described as a seventh embodiment with reference to FIGS. 25 and 26.

With the seventh embodiment, the intruded toner removal process is practiced not for the upper developing unit 10 but for the lower second developing unit 20 only which is exposed to a larger amount of extraneous toner, to weight the developing units 10 and 20 according to the up-down position relation therebetween. The control steps involved are the same as steps S140 to S145 and S147 to S152 shown in FIG. 19. Although the process of FIG. 19 includes step S146 of intruded toner removal process A, this step is not included in the process of FIG. 25. When P—P development is selected, however, step S152 is followed to execute the subroutine of intruded toner removal process B which is the same as the process of FIG. 21.

Figure 26:
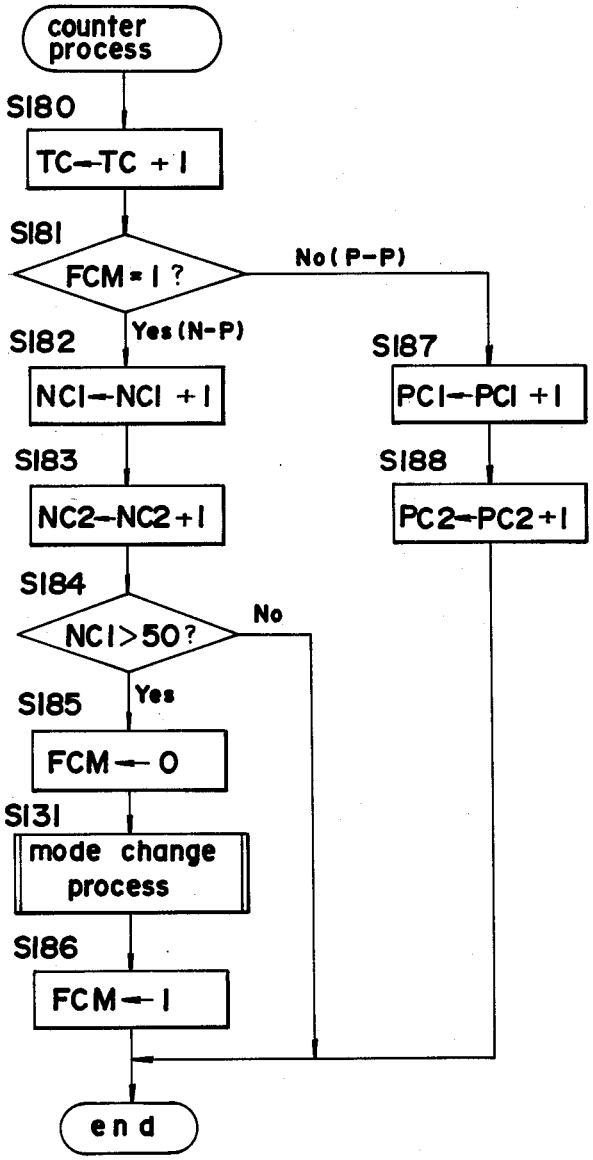

The counter process step S135 of FIG. 18 is shown in FIG. 26. This process of FIG. 26 includes steps which are the same as steps S180 to S188 of FIG. 22. In other words, the counter process of the seventh embodiment is the same as the process of FIG. 22 except that the steps S189 to S191 of FIG. 22 are not performed according to the embodiment.

Now with reference to FIGS. 20 and 27 to 29, an eighth embodiment will be described wherein the subroutine of intruded toner removal process A (see FIG. 20) is executed also for the upper developing unit 10. The mode change subroutine in this case is generally similar to that shown in FIG. 25 except that the intruded toner removal process A, which is not shown in FIG. 25, is executed as step S146 in FIG. 27. The subroutine of intruded toner removal process A is shown in FIG. 20 and already described with reference to the fifth embodiment.

Figure 27:
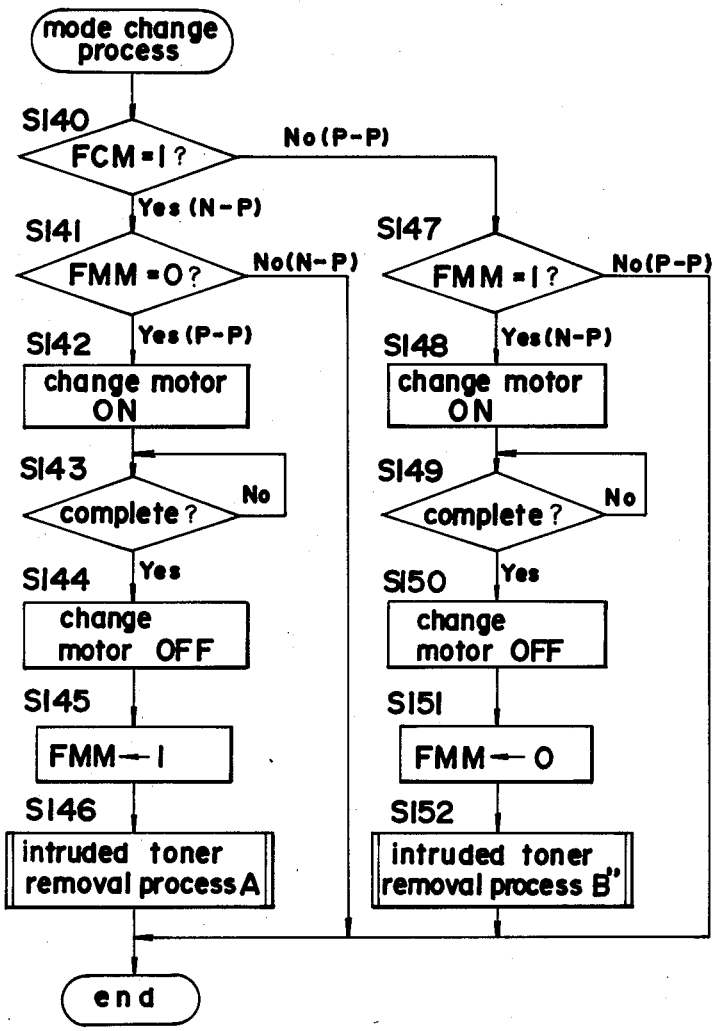
FIGS. 27 to 29 are flow charts showing another embodiment.
Figure 28:
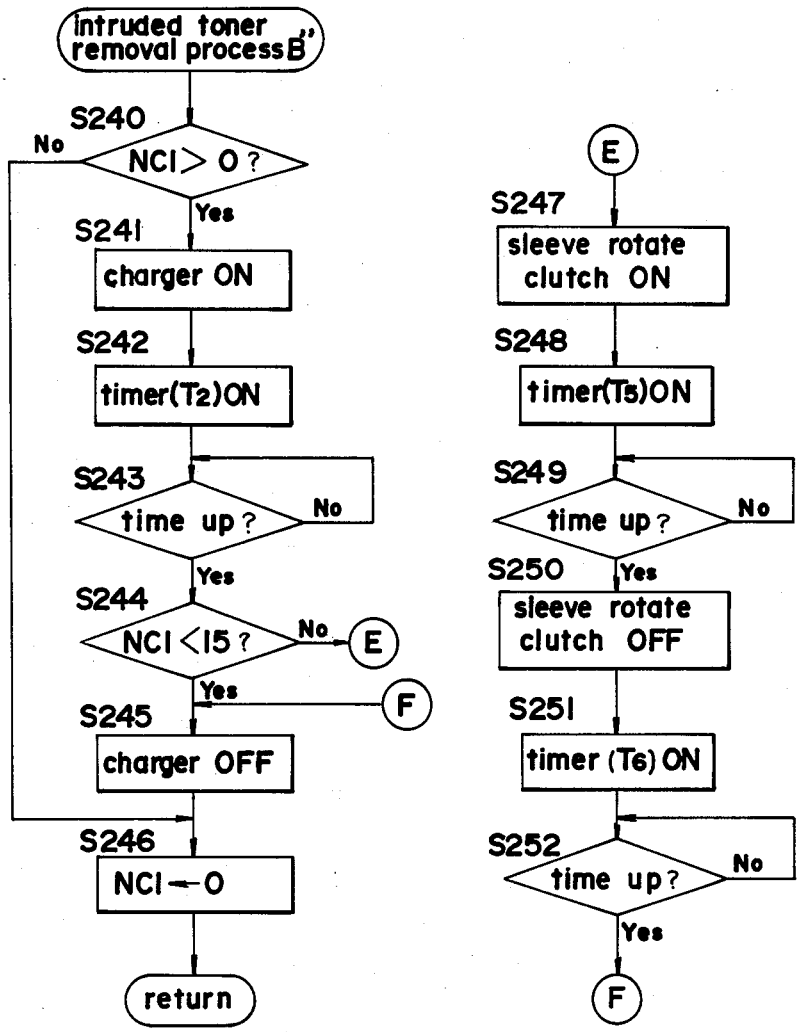

Next, the subroutine of intruded toner removal process B″ to be executed as step S152 of FIG. 27 will be described with reference to FIG. 28. The process B″, which is an improvement over the intruded toner removal process B′, involves weighting according to the number of copies and is basically the same as the process shown in FIG. 24, except that although step S220 of FIG. 24 checks whether the count value of the counter NC1 is greater than "5", the process B″ includes step S240 of checking whether the count value of the counter NC1 is greater than "0".

Thus, the subroutine of intruded toner removal process B″ of the eighth embodiment is so designed that when the number of copies obtained in the preceding developing mode is not smaller than 15, not only the developer positioned at the developing station Yb but also another developer portion, as transported to the station Yb by slightly rotating the sleeve 21, is treated for removing the intruded toner, since when the developing cycle is repeated many times continually, an increased amount of extraneous toner scatters and intrudes into the unit and is not fully removable by treating only the developer at the station Yb.

Figure 29:
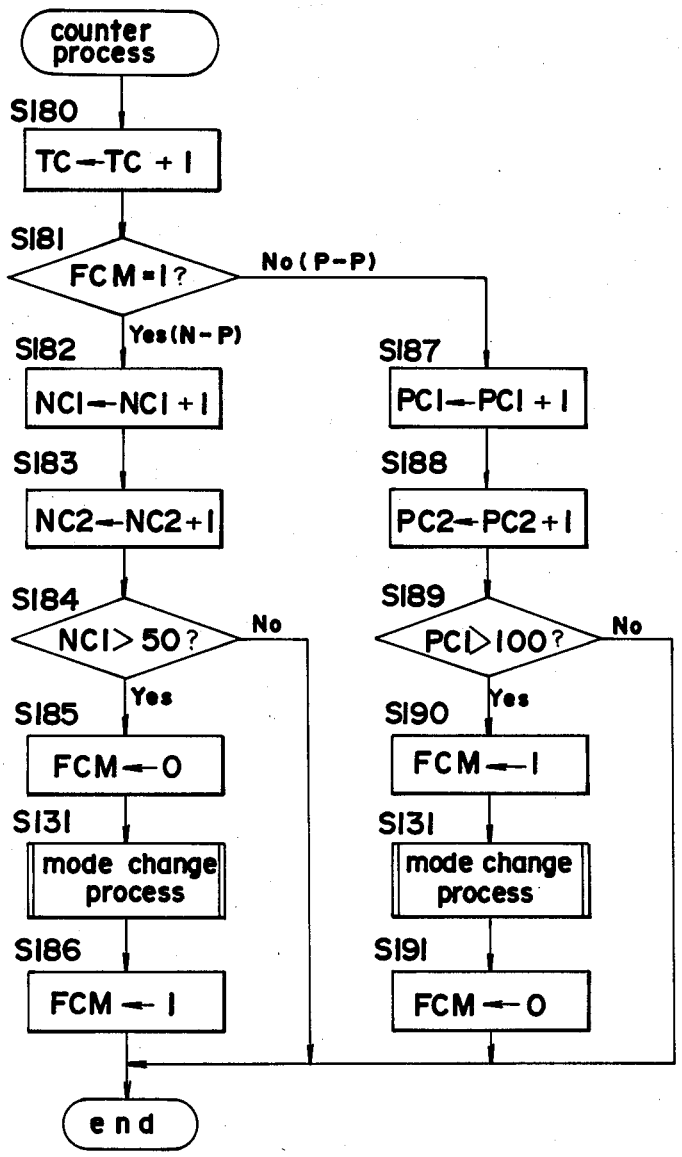

As shown in FIG. 29, the subroutine of counter process is basically the same as the counter process subroutine of the seventh embodiment (see FIG. 26). In this case, however, the intruded toner removal process is executed also for the upper developing unit 10, so that the counter PC1 is checked as to whether its count value is greater than "100" in the step subsequent to step S188. When the value is up to "100" (NO), this subroutine is completed, whereas if it is not smaller than "101" (YES), steps S190 set seq. are executed.

Briefly, when only one of the developing units is operated continuously for copying, the intruded toner removal process for the other developing unit is executed in the following manner. The process is executed for the lower unit 20 after the upper unit 10 has been used for making not smaller than 51 copies (steps S184 to S186), while the process is executed for the upper unit 10 after the lower unit 20 has been used for making not smaller than 101 copies (steps S189 to S191). Such weighting is due to the fact that the toner is liable to scatter downward under gravity.

Figure 30:
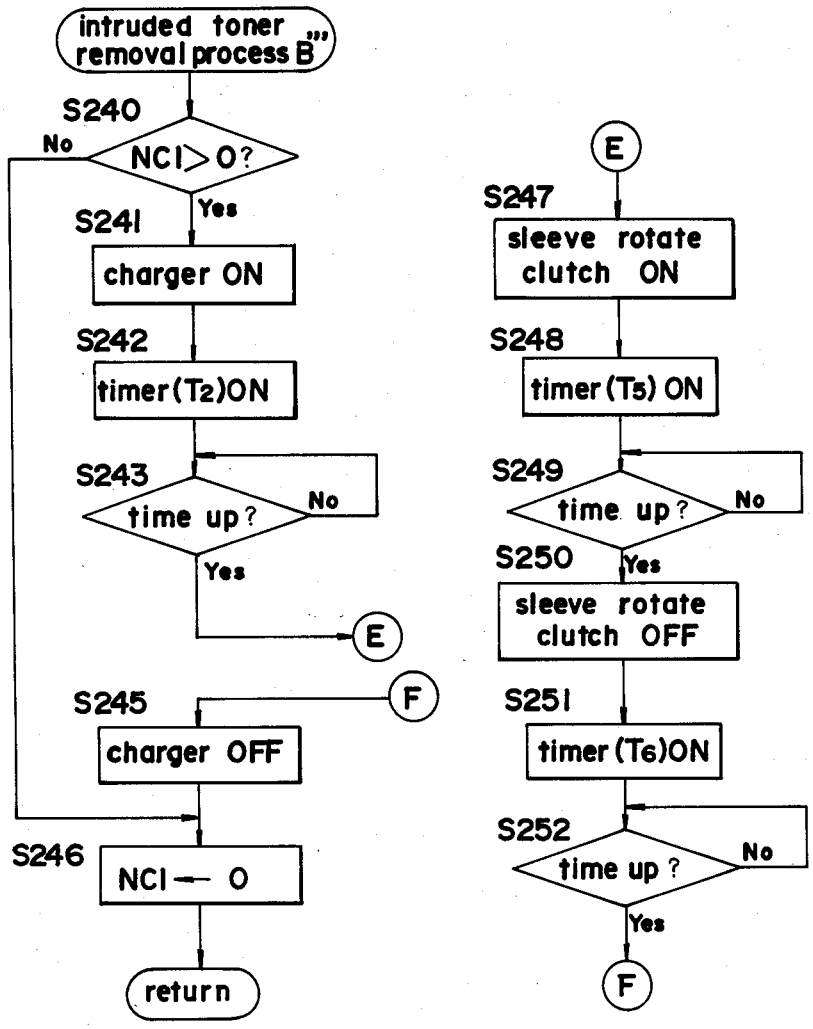
FIG. 30 is a flow chart showing another embodiment.

A ninth embodiment will be described which is the same as the eighth embodiment except that the subroutine of intruded toner removal process B' shown in FIG. 30 is executed for the lower developing unit 20. With this embodiment, the subroutine of intruded toner removal process A shown in FIG. 20 is executed for the upper developing unit 10. The subroutine for the lower developing unit 20 is basically the same as the intruded toner removal process B" shown in FIG. 28 already mentioned, with the exception of the following. When step S243 recognizes that the time set on the timer T2 is up, i.e., upon the removal of the intruded toner Tb from the developing station Yb, steps S247 to S252 and subsequently steps S245 and S246 are immediately executed to remove the developer also from the vicinity of the station Yb.

Figure 31:
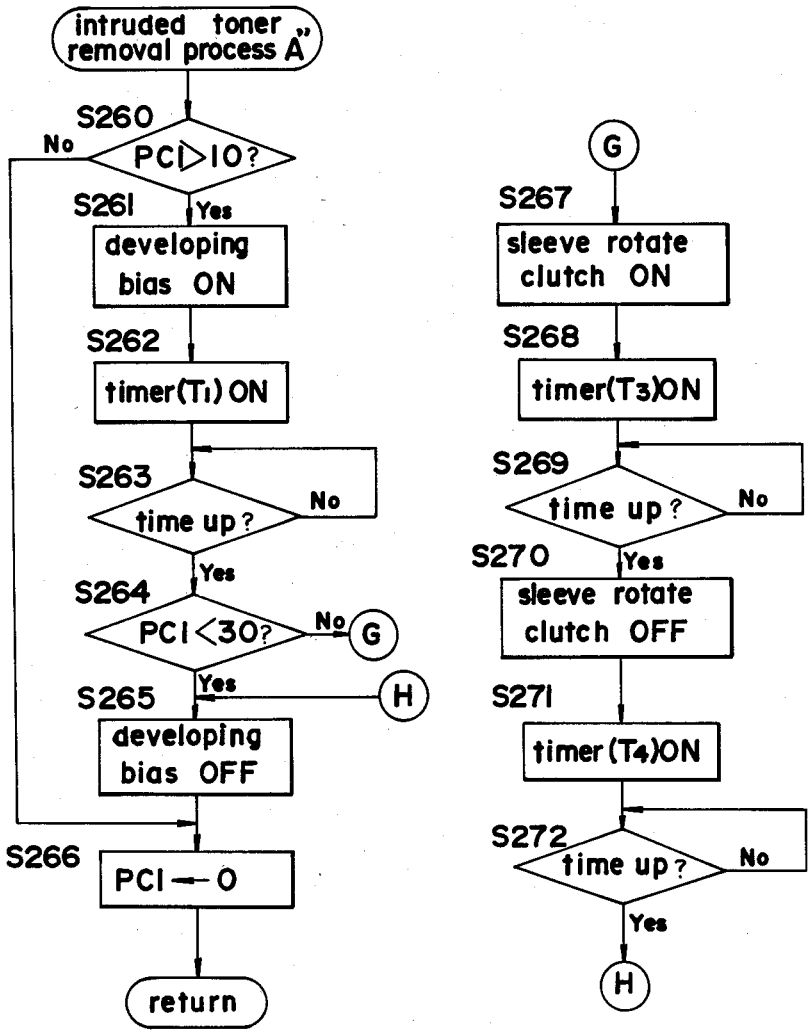
FIG. 31 is a flow chart showing still another embodiment.

A tenth embodiment of the present invention will be described with reference to FIGS. 31 and 32.

Figure 24:
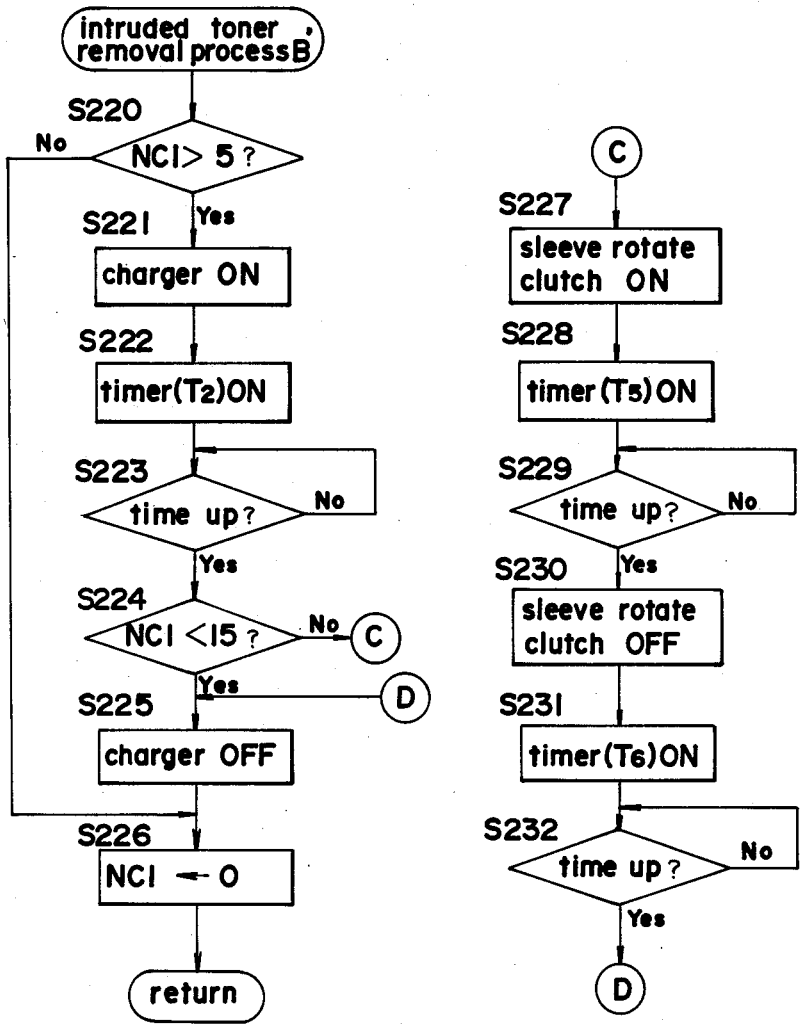

The tenth embodiment is the same as the eighth embodiment with the exception of executing the subroutine of intruded toner removal process A" substantially similar to the removal process A' shown in FIG. 23 and executing the subroutine of intruded toner removal process B' shown in FIG. 24. The removal process A" differs from the removal process A' in respect of the following steps. Whereas step S200 of FIG. 23 checks the counter PC1 as to whether its count value is greater than "5", step S260, shown in FIG. 31, of the process A" checks whether the count value on the counter PC1 is greater than "10". If the value is up to "10", step S266 follows, while if it is greater than "10", steps S261 to S263 follow. The subsequent step S264 checks whether the count of the counter PC1 is greater than "30". When it is greater, step S265 follows, or if otherwise, the sequence proceeds to step S267, which is followed by the same corresponding steps as shown in FIG. 23.

The intruded toner removal process B' is the same as the process shown in FIG. 24.

It is desirable that the direction of slight rotation of the developing sleeve 11 in steps S267 and S270 be opposite to the direction of arrow b because the developing sleeve 11 of the upper unit is exposed to the scattering toner at the downstream side of the developing station Ya.

The foregoing seventh to tenth embodiments are so adapted that the toner deposited on the outer periphery of the sleeve of one developing unit from the other unit is removed with weighting according to the position relation between the units. The seventh embodiment involves such weighting that the intruded toner removal process is executed for the lower developing unit 20 only. Although the removal process is executed for both upper and lower units 10 and 20 with the eighth embodiment, the lower unit 20 is so weighted that when the upper unit 10 is used for making not smaller than 15 copies continually, the toner intruding into the developer is removed also from the vicinity of the developing station Yb by slightly rotating the developing sleeve 21. Further in the case of the eighth embodiment, the subroutine of mode change process is executed when the number of copies continually made by the selected developer exceeds a specified number to remove the intruded toner from the unselected developing unit. The removal process is practiced with such weighting that the specified number is 50 for the upper unit 10, or 100 for the lower unit 20. The ninth and tenth embodiments similarly involve such weighting.

According to the ninth embodiment, the intruded toner removal process for the lower developing unit is so weighted that the developing sleeve 21 is slightly rotated always to remove the toner intruding into the developer also from the vicinity of the developing station Yb. The intruded toner removal process of the tenth embodiment is so weighted that when the developing mode is changed, the number of copies to be subsequently produced by the selected developing unit without executing the removal process is 10 for the upper unit 10, or 5 for the lower unit 20. The embodiment further involves such weighting that the number of produced copies which is to be followed by elaborate intruded toner removal by the slight rotation of the developing sleeve 11 or 21 is 30 for the upper unit 10, or 15 for the lower unit 20.

With the present invention, the weighting according to the position relation between the developing units is not limited to the modes described with reference to the embodiments; image forming apparatus may be individually assigned suitable weights. Although the number of copies is used as a measure of the amount of copying in the foregoing embodiments, the developing unit operates for different periods of time for making copies of different sizes, permitting intrusion of different amounts of extraneous toner. To be precise, therefore, it is desirable to determine the amount of copying based on the operating time of each developing unit which is dependent on the copy size, in weighting the developing units according to the position of the units relative to each other. Further even if the toner removal process is to be executed when a predetermined weighted amount of copying has been reached during a continuous copying operation, the removal process may be practiced on completion of the continuous copying operation.

The seventh to tenth embodiments described above are so adapted that the toner released from one developing unit onto the sleeve outer periphery of the other unit is removed with weighting according to the position relation between the units. Consequently, the intruded toner is removable efficiently and completely in accordance with the degree of intrusion.

Preferably, a plurality of developing units are arranged in the following manner.

First, the developing unit which is used more frequently is to be positioned at a lower level. Since the toner is liable to scatter downward under gravity as already described, this arrangement reduces the amount of intruding toner. Next, it is desirable to position at a lower level the developing unit containing a developer which is less susceptible to the adverse influence of an extraneous toner from the viewpoint of the triboelectric series of developers, because the extraneous toner is likely to intrude into the lower developing unit in view of the toner scattering direction. For example, it is because the P—P developer is less likely to be adversely affected by the extraneous toner that the unit 20 for P—P development is set in the lower stage in the foregoing embodiments. However, with reader-printers which are used chiefly for N—P development and in which the adverse effect of the extraneous toner need not be considered seriously, it is desirable to position at a lower level the developing unit 10 to be used more frequently for N—P development.

The control process of the present invention is applicable also to image forming apparatus comprising two developing units as arranged one above the other, one unit accommodating a developer containing a red, blue, yellow or like monochromatic toner, the other unit being filled with a developer containing a black toner. In this case, the black toner is less prone to the adverse effect of the color toner and more frequently used, so that it is desirable to provide the unit for black development at the lower position.

With color image forming apparatus having three or four developing units accommodating different monochromatic toners individually, the developing units to be operated individually are controllable by the process of the present invention.

According to the above embodiments, the developing sleeve is rotated to transport the developer, but the present invention is not limited to this mode of transport. For example, the magnet is rotated for transporting the developer. In this case, the developer is halted by stopping the rotation of the magnet. When the magnet and the sleeve are both adapted for rotation, the rotation of both is discontinued to stop the travel of the developer.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus having a plurality of developing units, one of which is selectively used for development, said image forming apparatus comprising:

an electrostatic latent image bearing member;

a developing sleeve provided at each of the developing units for moving a developer to a position opposite the image bearing member;

developing unit selecting means for positioning the developing sleeve of one of the developing units selected at a position opposite the image bearing member and moving the developing sleeve of another developing unit from the position opposite the image bearing member;

control means for stopping movement of the developer positioned on an outer periphery of the developing sleeve of the developing unit not selected by the selecting means;

developer removing means for causing the developing unit selecting means to select the developing unit not used for development to remove and collect the developer positioned on the outer periphery of the developing sleeve thereof; and input means for providing an input signal in order to specify the developing unit to be selected by said developing unit selecting means.

2. The image forming apparatus as claimed in claim 1 wherein said developer removing means comprises control means for removing the developer positioned on the outer periphery of the developing sleeve of the developing unit selected by the input means by causing the developer to adhere to an area other than an image forming surface area of the image bearing member before the developing unit selected by the input means is initiated into operation.

3. An image forming apparatus as claimed in claim 1 wherein said developer removing means has a plurality of developing modes.

4. The image forming apparatus as claimed in claim 3 wherein said developer removing means selects one of said developing modes, for removing and collecting the developer positioned on the developing sleeve of the developing unit selected by the input means according to the operation of the developing unit which has been in use.

5. The image forming apparatus as claimed in claim 3 wherein, in response to operation of said developer removing means, the selecting means selects the developing unit not used for development and removes and collects the developer positioned on the developing sleeve of the developing unit selected by the developing unit selecting means after current operation of the developing unit selected by the input means has produced a predetermined number of copies.

6. The image forming apparatus as claimed in claim 3 wherein said developer removing means selects one of said developing modes, for removing and collecting the developer on the developing unit selected by the developing unit selecting means according to the position of the developing unit selected by said developing unit selecting means.

* * * * *